US010532878B2

(12) United States Patent
Homma et al.

(10) Patent No.: US 10,532,878 B2
(45) Date of Patent: Jan. 14, 2020

(54) PILL CASE

(71) Applicants: NEC Corporation, Minato-ku, Tokyo (JP); NEC Platforms, Ltd., Kawasaki-shi, Kanagawa (JP)

(72) Inventors: Yasuyuki Homma, Kanagawa (JP); Yasushi Nakano, Kanagawa (JP)

(73) Assignees: NEC CORPORATION, Tokyo (JP); NEC PLATFORMS, LTD, Kanagawa (JP)

( * ) Notice: Subject to any disclaimer, the term of this patent is extended or adjusted under 35 U.S.C. 154(b) by 3 days.

(21) Appl. No.: 15/506,837

(22) PCT Filed: Jul. 6, 2015

(86) PCT No.: PCT/JP2015/069412

§ 371 (c)(1),
(2) Date: Feb. 27, 2017

(87) PCT Pub. No.: WO2016/042887

PCT Pub. Date: Mar. 24, 2016

(65) Prior Publication Data

US 2017/0259985 A1 Sep. 14, 2017

(30) Foreign Application Priority Data

Sep. 17, 2014 (JP) ..... 2014-188520

(51) Int. Cl.
*B65D 83/04* (2006.01)
*A61J 1/03* (2006.01)
(Continued)

(52) U.S. Cl.
CPC ..... *B65D 83/0409* (2013.01); *A61J 1/03* (2013.01); *B65D 43/22* (2013.01); *B65D 43/24* (2013.01); *B65D 2583/0481* (2013.01)

(58) Field of Classification Search
CPC ..... A61J 1/02; A61J 7/02; B65D 83/0409; B65D 83/0418; B65D 2585/56; B65D 43/22
See application file for complete search history.

(56) References Cited

U.S. PATENT DOCUMENTS 4,354,619 A * 10/1982 Wippernnann .... B65D 83/0409 206/540
4,405,060 A * 9/1983 Hsei ..... B65D 83/0409 221/135
(Continued)

FOREIGN PATENT DOCUMENTS

JP H06-039021 2/1994
JP H07-137775 A 5/1995
(Continued)

OTHER PUBLICATIONS

International Search Report for PCT Application No. PCT/JP2015/069412, dated Sep. 1, 2015.

*Primary Examiner* — Gene O Crawford
*Assistant Examiner* — Kelvin L Randall, Jr.

(57) ABSTRACT

A pill case (100) includes a pocket (9) which receives one pill (10) from an accommodation unit (8) in which a plurality of pills (10) are accommodated, and an extraction port (11) for ejecting the pill (10) in the pocket (9) to the outside. The pill case (100) includes a manipulation unit (for example, pill ejection button (4) and pill tray (5)) which converts a state in which the pill (10) in the pocket (9) cannot be ejected through the extraction port (11) to a state in which the pill (10) in the pocket (9) can be ejected through the extraction port (11) by being manipulated by a user. The pill case (100) includes a moving unit which is moved by indirectly or directly receiving a pressure from the pill (10) in the pocket (9) according to the moving manipulation to the manipulation unit, and a detection unit which detects that
(Continued)

the moving unit is moved up to a position of the moving unit which corresponds to a state in which the pill (10) in the pocket (9) can be ejected.

7 Claims, 14 Drawing Sheets

(51) Int. Cl.
*B65D 43/22* (2006.01)
*B65D 43/24* (2006.01)

(56) References Cited

U.S. PATENT DOCUMENTS 4,415,098 A * 11/1983 Haas ..... B65D 83/0409 221/202
5,174,471 A 12/1992 Kozlowski et al.
5,259,531 A 11/1993 Bennett
6,131,765 A * 10/2000 Barry ..... A47F 1/035 221/264
6,849,457 B1 * 2/2005 Babson ..... B01L 3/0289 221/264
2002/0067270 A1 6/2002 Yarin et al.
2002/0175180 A1 * 11/2002 Evans ..... B65D 43/021 221/298
2003/0234260 A1 12/2003 Giraud
2009/0284355 A1 11/2009 Kiran
2011/0193705 A1 8/2011 Sekura
2015/0136800 A1 * 5/2015 Dodo ..... B65D 83/0409 221/7

FOREIGN PATENT DOCUMENTS

JP 3028424 U 9/1996
JP 2003-310715 A 11/2003
JP 2005-500099 A 1/2005
JP 2005-529816 A 10/2005
JP 3114969 U 11/2005
JP 2007-176559 A 7/2007
JP 2009-538169 A 11/2009
JP 3158443 U 4/2010
JP 2011-042380 A 3/2011
JP 2011-200677 A 10/2011
JP 2014-042699 A 3/2014

* cited by examiner

PILL CASE

REFERENCE TO RELATED APPLICATION

This application is a National Stage Entry of PCT/JP2015/069412 filed on Jul. 6, 2015, which claims priority from Japanese Patent Application 2014-188520 filed on Sep. 17, 2014, the contents of all of which are incorporated herein by reference, in their entirety.

TECHNICAL FIELD

The present invention relates to a pill case.

BACKGROUND ART

In recent years, regarding management of whether a patient takes medicine as instructed by a doctor (hereinafter, referred to as medication management), Patent Documents 1 to 3 describe techniques of detecting and recording the ejection of a pill from a case.

In addition, Patent Documents 4 and 5 describe pill cases which can eject pills one by one.

Patent Documents 1 and 6 to 9 describe devices which assist a patient in taking medicine as instructed by a doctor, by informing the patient that the time for taking medicine has come, or the like.

RELATED DOCUMENT

Patent Document

[Patent Document 1] Japanese Laid-open Patent Publication No. 2014-042699

[Patent Document 2] Japanese Laid-open Patent Publication No. 2007-176559

[Patent Document 3] Japanese Laid-open Patent Publication No. 2011-200677

[Patent Document 4] Japanese Registered Utility Model No. 3158443

[Patent Document 5] Japanese Registered Utility Model No. 3028424

[Patent Document 6] Japanese Laid-open Patent Publication No. 2003-310715

[Patent Document 7] PCT Japanese Translation Patent Publication No. 2005-500099

[Patent Document 8] Japanese Registered Utility Model No. 3114969

[Patent Document 9] PCT Japanese Translation Patent Publication No. 2009-538169

SUMMARY OF THE INVENTION

For the medication management or the like, it is desired to achieve both of a configuration of ejecting pills one by one from the pill case and a configuration of detecting the ejection of a pill from the pill case when the pill is ejected.

An object of the invention is to provide a pill case which can eject pills one by one, and can detect the ejection of a pill when the pill is ejected.

According to the invention, there is provided a pill case including a case main body provided with an accommodation unit in which a plurality of pills can be accommodated; a pocket which can receive one pill from the accommodation unit; an extraction port for ejecting the pill in the pocket to the outside; a manipulation unit which converts a state in which the pill in the pocket cannot be ejected through the extraction port to a state in which the pill in the pocket can be ejected through the extraction port by being manipulated to be moved relative to the case main body by a user; a moving unit which is moved by indirectly or directly receiving a pressure from the pill in the pocket according to the moving manipulation to the manipulation unit; and a detection unit which detects that the moving unit is moved up to a position of the moving unit which corresponds to a state in which the pill in the pocket can be ejected through the extraction port.

According to the invention, it is possible to eject pills one by one from the pill case, and to detect the ejection of a pill when the pill is ejected.

BRIEF DESCRIPTION OF THE DRAWINGS

The above described objects, other objects, features, and advantages are clarified by preferred embodiments described below and the accompanying drawings.

FIG. 1A is a perspective view, and FIG. 1B is a plan view.

FIG. 3A is a plan view, FIG. 3B is a sectional view taken along line A-A of FIG. 3A, and FIG. 3C is a sectional view taken along line B-B of FIG. 3A.

FIGS. 4A and 4B are sectional views taken along line C-C of FIG. 3A.

FIG. 8A is a perspective view, and FIG. 8B is a plan view.

FIGS. 11A and 11B are perspective views of the pill case, and FIG. 11C is a plan view of a manipulation member.

DESCRIPTION OF EMBODIMENTS

Figure 1:
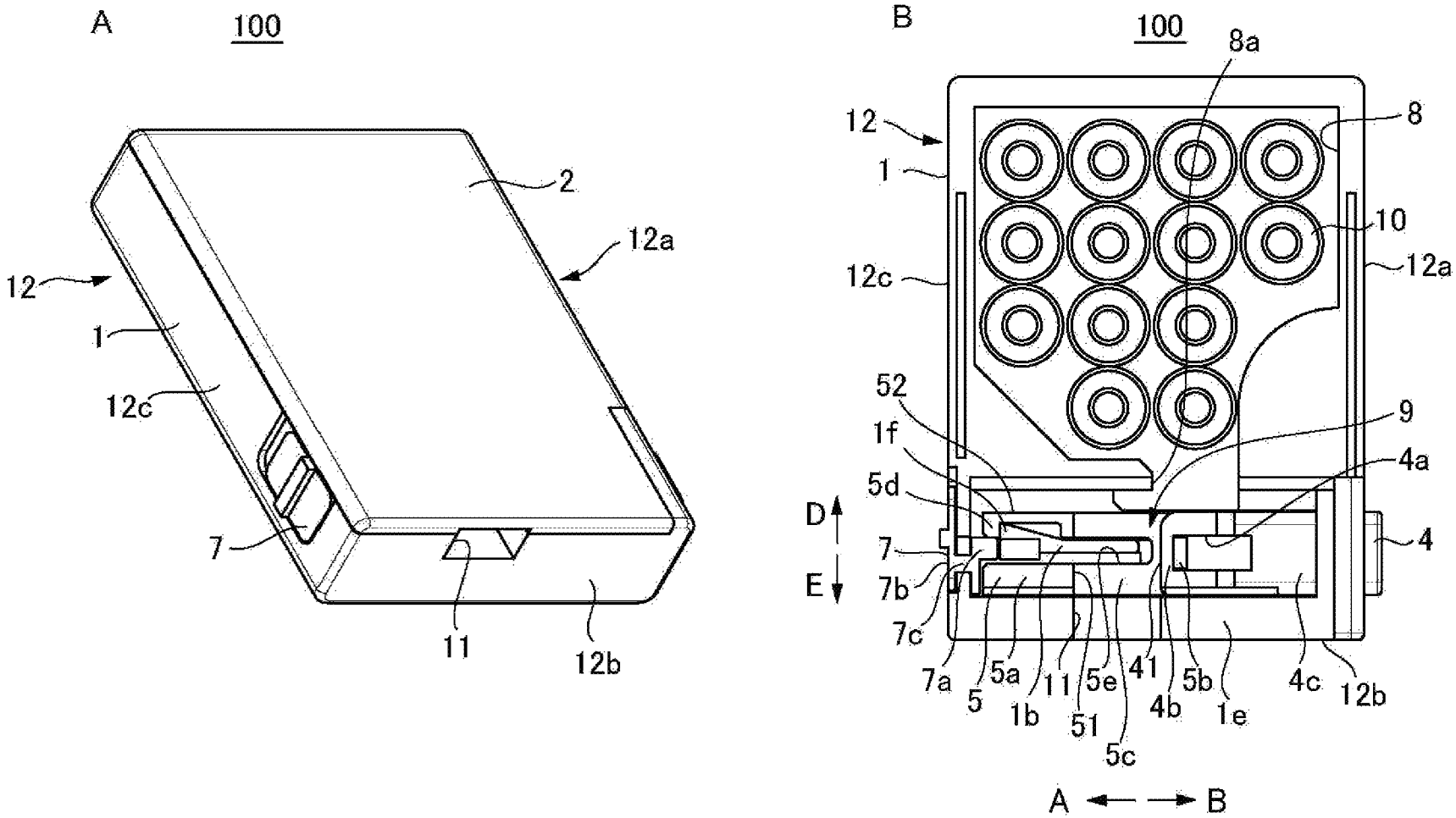
FIG. 1 is a diagram illustrating a pill case according to a first embodiment.

Hereinafter, embodiments of the invention will be described using the drawings. In all the drawings, the same reference numerals are assigned to the same constituent elements, and the description thereof will not be repeated.

[First Embodiment]

FIG. 1 is a diagram illustrating a pill case 100 according to a first embodiment, FIG. 1A is a perspective view, and FIG. 1B is a plan view.

Figure 2:
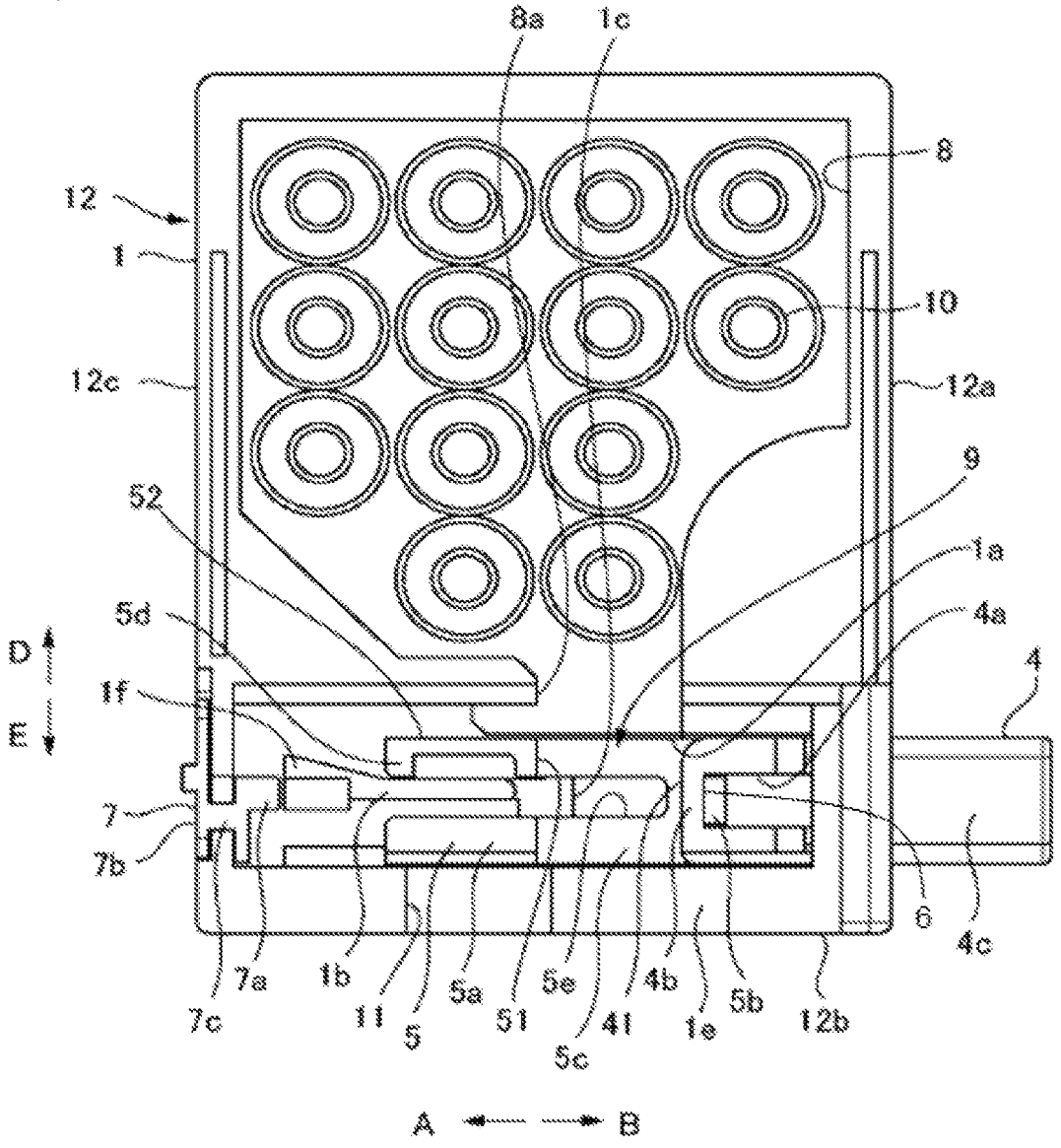
FIG. 2 is a plan view of the pill case according to the first embodiment, and illustrates a state in which child resistance is released.

FIG. 2 is a plan view of the pill case 100 according to the first embodiment, and illustrates a state in which child resistance is released and a pill ejection button 4 protrudes.

In FIG. 1B and FIG. 2, the internal structure of the pill case 100 is illustrated by seeing through a first housing member 1.

Figure 3:
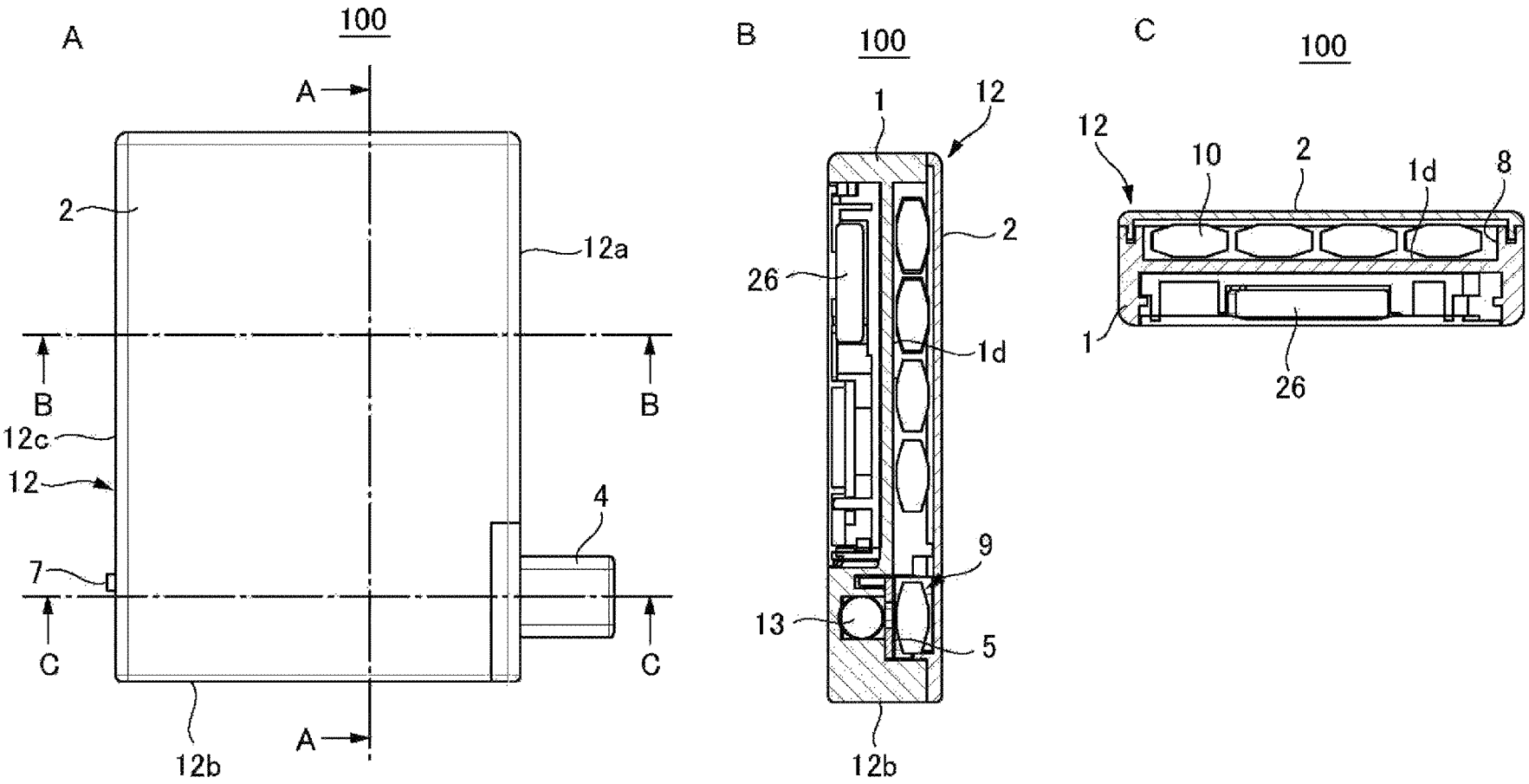
FIG. 3 is a diagram illustrating the pill case according to the first embodiment.

FIG. 3 is a diagram illustrating the pill case 100 according to the first embodiment, FIG. 3A is a plan view, FIG. 3B is a sectional view taken along line A-A of FIG. 3A, and FIG. 3C is a sectional view taken along line B-B of FIG. 3A.

Figure 4:
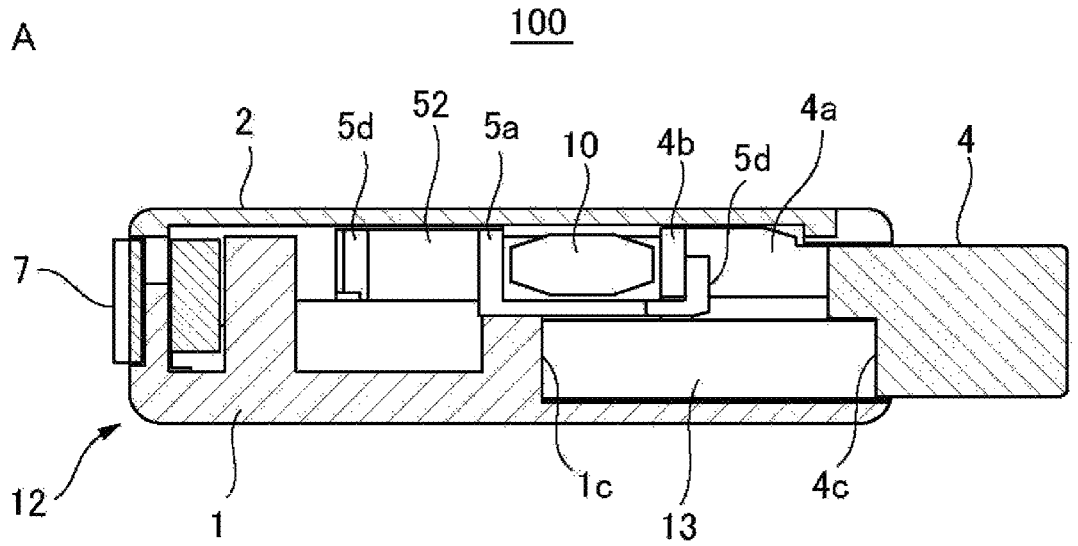
FIG. 4 is a diagram illustrating an operation of a pill ejection button of the pill case according to the first embodiment.
Figure 4:
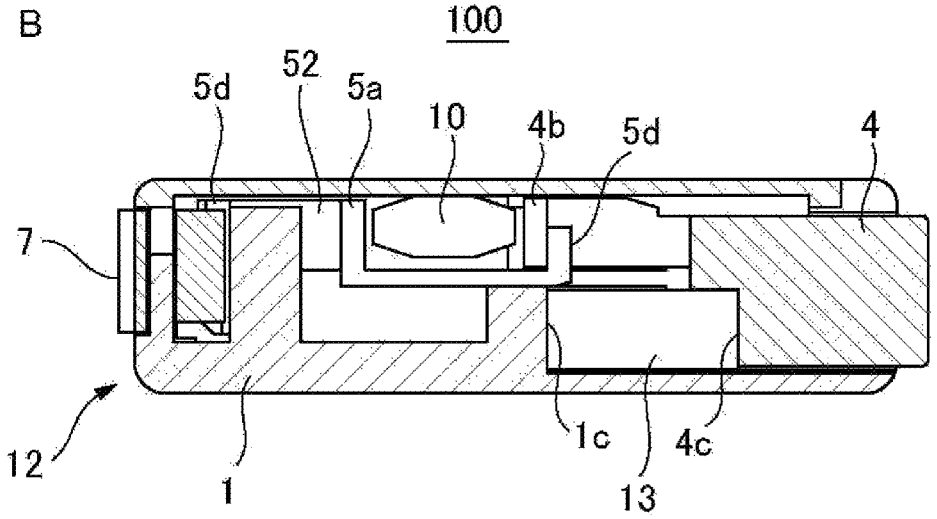

FIG. 4 is a diagram illustrating an operation of the pill ejection button 4 of the pill case 100 according to the first embodiment, and FIGS. 4A and 4B are sectional views taken along line C-C of FIG. 3A. FIG. 4A illustrates a state in which the pill ejection button 4 is not pressed, and FIG. 4B illustrates a state in which the pill ejection button 4 is pressed.

FIGS. 5A to 5C and FIGS. 6A to 6C are diagrams illustrating flows of an operation of ejecting a pill 10 from the pill case 100 according to the first embodiment.

FIGS. 7A to 7E are perspective views illustrating a detection operation by a detection unit (detection sensor 16) of the pill case 100 according to the first embodiment, and extract and illustrate a configuration relating to the detection operation.

The pill case 100 according to this embodiment is the pill case 100 which can eject the pills 10 one by one to the outside by the manipulation of a user.

The pill case 100 includes a case main body 12 provided with an accommodation unit 8 in which a plurality of pills 10 can be accommodated, a pocket 9 which can receive one pill 10 from the accommodation unit 8, and an extraction port 11 for ejecting the pill 10 in the pocket 9 to the outside.

The pill case 100 further includes a manipulation unit which converts a state in which the pill 10 in the pocket 9 cannot be ejected through the extraction port 11 to a state in which the pill 10 in the pocket 9 can be ejected through the extraction port 11 by being manipulated to be moved relative to the case main body 12 by a user. In this embodiment, the manipulation unit is configured by the pill ejection button 4 and a pill tray 5, for example.

The pill case 100 further includes a moving unit (for example, moving member 15 (FIG. 7)) which is moved by indirectly or directly receiving a pressure from the pill 10 in the pocket 9 according to the moving manipulation to the manipulation unit.

The pill case 100 further includes a detection unit (detection sensor 16 (FIG. 7) which detects that the moving unit is moved up to a position of the moving unit which corresponds to a state in which the pill 10 in the pocket 9 can be ejected through the extraction port 11.

Accordingly, in a state in which the pill 10 is accommodated in the pocket 9, when the manipulation unit is manipulated for ejecting the pill 10 through the extraction port 11, the moving unit is moved by receiving a pressure from the pill 10, and the movement is detected by the detection unit.

Thus, it is possible to detect the ejection of the pill 10 when the pill 10 is ejected.

Meanwhile, in a state in which the pill 10 is not accommodated in the pocket 9, even when the manipulation unit is manipulated, since the moving unit does not receive a pressure from the pill 10, the moving unit is not moved, and thus the detection unit does not detect the movement.

In other words, in a case where the pill 10 is not ejected to the extraction port 11 even when the manipulation unit is manipulated, the detection unit is configured not to detect the ejection of the pill 10.

Thus, it is possible to detect the ejection of the pill 10 only in a case where the pill 10 is ejected.

Hereinafter, description will be given in detail.

As illustrated in FIGS. 1A, 3B, 3C, and the like, the case main body 12 is formed in, for example, a flat shape by assembling a plurality of members including the first housing member 1 and a second housing member 2 to each other. As illustrated in FIG. 1B, the case main body 12 is formed in, for example, a substantially rectangular shape when seen in a plan view. However, the shape of the case main body 12 is not limited to the example.

The first housing member 1 is formed in a flat shape having a rectangular shape when seen in a plan view, and a concave portion 1*d* having a predetermined shallow depth is formed on one surface thereof. The second housing member 2 is a lid body which blocks an opening end of the concave portion 1*d* of the first housing member 1. The flat accommodation unit 8 (FIGS. 1B, 2, and 3C) is formed by the region surrounded by the concave portion 1*d* and the second housing member 2.

The accommodation unit 8 can accommodate a plurality of pills 10.

Here, the pill 10 accommodated in the accommodation unit 8 has a flat shape in which the planar shape is a circle and the thickness thereof is smaller than the diameter thereof.

The pill 10 is accommodated in the accommodation unit 8 in a posture in which the thickness direction of the pill 10 and the thickness direction of the case main body 12 match to each other. The dimension of the accommodation unit 8 in the thickness direction of the case main body 12 is set to be slightly greater than the thickness of the pill 10 accommodated in the accommodation unit 8. Therefore, the pill 10 in the accommodation unit 8 is prevented from having a posture in which the thickness direction of the pill 10 is orthogonal to the thickness direction of the case main body 12.

When the case main body 12 is inclined, the pill 10 in the accommodation unit 8 can be moved by its own weight.

As illustrated in FIGS. 1, 2, 4, and the like, the pill ejection button (first portion of the manipulation unit) 4 is provided in the case main body 12. In this embodiment, the first portion of the manipulation unit is a part which is directly manipulated to be moved by a user.

A part of the pill ejection button 4 is accommodated inside the case main body 12, and a part thereof protrudes to the outside of the case main body 12 (in an arrow B direction in FIG. 2).

In more detail, for example, the pill ejection button 4 is disposed along one end surface 12*b* of the case main body 12, and a part thereof protrudes from one side surface 12*a* of the case main body 12.

The end surface 12*b* and the side surface 12*a* intersect with each other (for example, are orthogonal to each other).

The ejection manipulation of the pill 10 by a user is performed by pressing the pill ejection button 4 in an arrow A direction.

As illustrated in FIG. 2, the pill tray (second portion of the manipulation unit) 5 has an interior wall 6 and is provided in the case main body 12.

The part of the pill ejection button 4 which is positioned inside the case main body 12 and the pill tray 5 are accommodated in a groove 1*a* formed in the first housing member 1. The groove 1*a* is formed on one end of the first housing member 1 along the end surface 12*b* of the case main body 12.

The pill ejection button 4 is guided by the groove 1*a*, and is movable in the longitudinal direction of the groove 1*a* (a horizontal direction in FIG. 2 (the arrow A direction and the arrow B direction that is opposite to the arrow A direction)).

In addition, the pill tray 5 is guided by the groove 1*a* and a rib 1*b* to be described below, and is movable in the longitudinal direction of the groove 1*a*.

In more detail, for example, each of the pill ejection button 4 and the pill tray 5 is linearly movable.

The second housing member 2 regulates falling of the pill ejection button 4 and the pill tray 5 from the groove 1*a* to the front side of the paper in FIG. 2.

A slit 4*a* extending in the horizontal direction in FIG. 2 is formed in the pill ejection button 4. The pill ejection button 4 includes a to-be-locked portion 4*b* which blocks a left end of the slit 4*a*, and a reception portion 4*c* (FIG. 4) that receives an end of a spring 13 to be described below.

The pill tray 5 includes a main body portion 5*a*, a first locking portion 5*b* disposed to be away from the main body portion 5*a* in the right direction in FIG. 2, a tray portion 5*c* which connects the first locking portion 5*b* , which is a projection, and the main body portion 5*a* to each other, and a second locking portion5*d* formed on the main body portion 5*a*.

The first locking portion 5*b* of the pill tray 5 has a pillar shape in which the first locking portion 5*b* is erect from the right end of the tray portion 5*c* toward the front side in the thickness direction of the case main body 12 (the front side of the paper in FIG. 2), and is inserted into the slit 4*a* of the pill ejection button 4. In this manner, the pill ejection button 4 and the pill tray 5 are connected to each other.

Here, the pill ejection button 4 and the pill tray 5 are connected such that the pill tray 5 is in conjunction with the pill ejection button 4 when the pill ejection button 4 is moved in one direction (the arrow B direction).

That is, in a case where the pill ejection button 4 is moved in the arrow B direction according to the bias of the spring 13 to be described below, the pill tray 5 follows the movement of the pill ejection button 4 to move in the arrow B direction in a state in which the first locking portion 5*b* and the to-be-locked portion 4*b* are locked with each other.

Meanwhile, when the pill 10 is not present in the pocket 9, if the pill ejection button 4 is moved in the arrow A direction, the engagement between the first locking portion 5*b* and the to-be-locked portion 4*b* is released, and the first locking portion 5*b* is moved in the arrow B direction relative to the pill ejection button 4, in the slit 4*a*. Therefore, the pill tray 5 is not moved in the arrow A direction in association with the pill ejection button 4.

A slit 5*e* extending in the right direction from the left end of the pill tray 5 in FIG. 2 is formed in the pill tray 5 from the main body portion 5*a* to the tray portion 5*c*. In the main body portion 5*a*, the second locking portion 5*d* is formed in one portion (for example, upper portion in FIG. 2) of two portions divided by the slit 5*e*.

The second locking portion 5*d* is formed in a tip end (the left end in FIG. 2) of the one portion of the main body portion 5*a*. The second locking portion 5*d* is a protrusion-shaped portion which protrudes toward the other portion (toward the arrow E direction in FIG. 2) of the two portions divided by the slit 5*e* in the main body portion 5*a*.

In the one portion of the main body portion 5*a*, a portion further on a base end side than the second locking portion 5*d* is a spring unit 52 which can be elastically deformed in an arrow D direction in FIG. 2. The arrow D direction is a direction opposite to an arrow E direction.

In addition, the arrow A direction, the arrow B direction, the arrow D direction, and the arrow E direction are directions included in the common plane, the arrow D direction and the arrow E direction are orthogonal to the arrow A direction and the arrow B direction.

The rib 1*b* which is erect in the thickness direction of the case main body 12 and extends in the horizontal direction in FIG. 2 is formed in the first housing member 1. The rib 1*b* is inserted into the slit 5*e* of the pill tray 5, and guides, in cooperation with the groove 1*a*, the pill tray 5 in the horizontal direction in FIG. 2.

In addition, the second locking portion 5*d* of the pill tray 5 is pressed against one surface of the rib 1*b* due to the spring action of the spring unit 52.

The tray portion 5*c* of the pill tray 5 is formed in a lower stage than the main body portion 5*a*, and the upper surface of the tray portion 5*c* (surface on the front side in the thickness direction of the case main body 12) is disposed flush with the bottom surface of the concave portion 1*d*.

The right end surface of the main body portion 5*a* of the pill tray 5 in FIG. 2 is a flat facing surface 51. Meanwhile, the left end surface of the pill ejection button 4 in FIG. 2 is a flat facing surface (flat surface) 41. The facing surface 41 and the facing surface 51 face each other in an approximately parallel manner across a space (space on the front side of the paper in FIG. 2) above the tray portion 5*c*. In addition, the facing surface 41 and the facing surface 51 are orthogonal to the arrow A direction.

Here, the pocket 9 is a region with an approximately rectangular parallelepiped shape which is configured of a space surrounded by the facing surface 41, the facing surface 51, the upper surface of the tray portion 5*c*, and the inner surface of the second housing member 2.

In other words, the pocket 9 is formed between the facing surface 41 of the pill ejection button 4 and the facing surface 51 of the pill tray 5.

The pocket 9 is formed to have a dimension and a shape capable of accommodating only one pill 10 at one time.

That is, the width of the pocket 9 in a vertical direction (the arrow D direction and the arrow E direction) in FIG. 2 is set to about the width of one pill 10 (corresponding to the diameter of the circular pill 10).

Similarly, the width of the pocket 9 in the horizontal direction (the arrow A direction and the arrow B direction) in FIG. 2 is set to about the width of one pill 10. However, it is preferable that the width of the pocket 9 in the horizontal direction in FIG. 2 is slightly greater than the width of one pill 10, and a slight clearance is present between the pill 10 in the pocket 9 and the facing surface 41 and the facing surface 51.

In a case where the pocket 9 is present at a position in FIG. 2, the pocket 9 communicates with the accommodation unit 8, and can receive the pill 10 in the accommodation unit 8.

Figure 6:
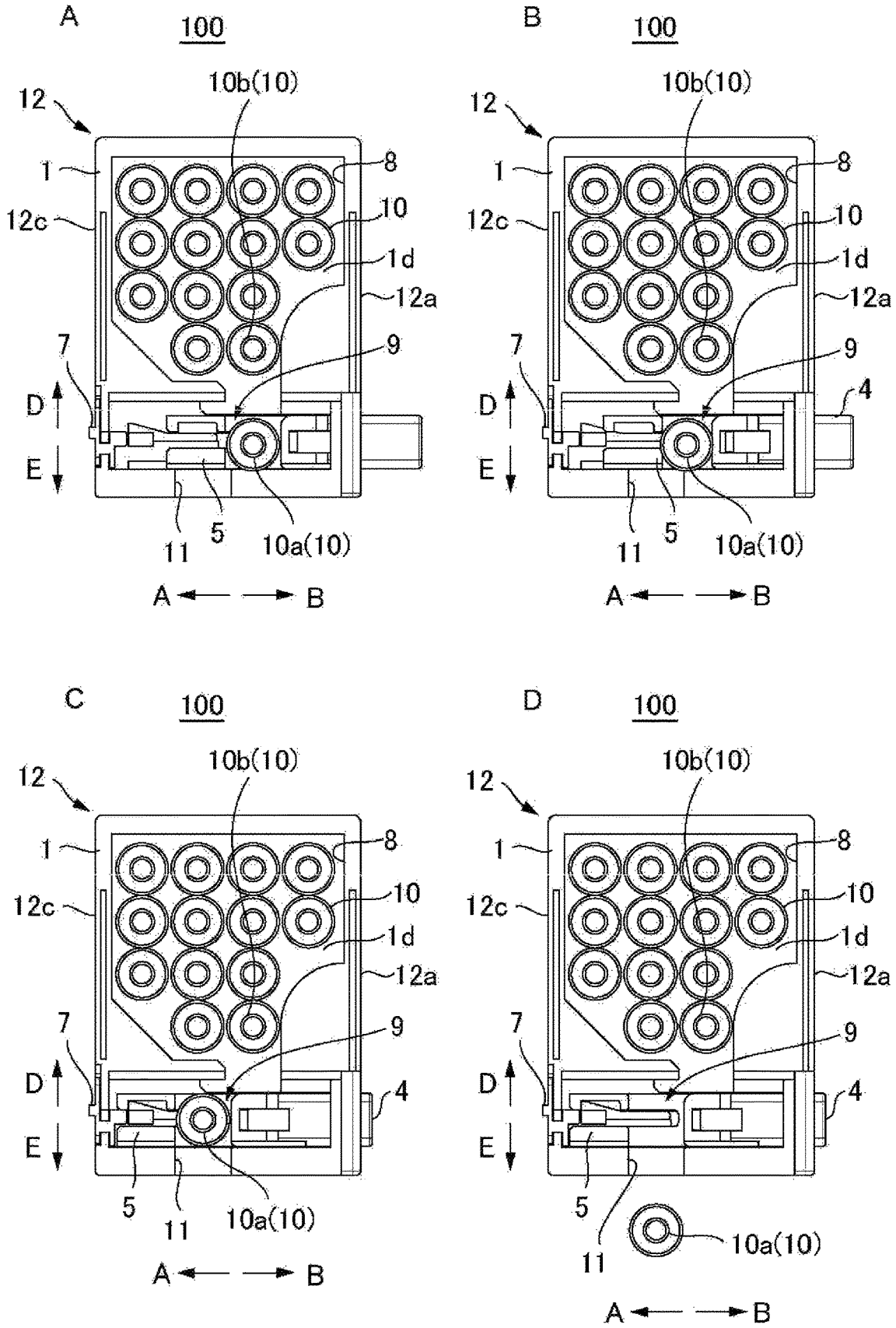
FIG. 6 is a diagram illustrating a flow of an operation of ejecting a pill from the pill case according to the first embodiment.

That is, in the state illustrated in FIG. 2, when the pill case 100 is inclined such that the pocket 9 is positioned on the lower side than the accommodation unit 8, one pill 10 flows from the accommodation unit 8 into the pocket 9, and the corresponding pill 10 is held in the pocket 9 (refer to FIG. 6A).

An end of the facing surface 41 on the side of the accommodation unit 8 side is subjected to rounding processing so as to be capable of smoothly receiving the pill 10 from the accommodation unit 8 to the pocket 9.

In addition, an end of the accommodation unit 8 on the pocket 9 side is an outlet 8*a* formed in a manner that the width in the horizontal direction in FIG. 2 is substantially the same as the width of the pocket 9. In the state in FIG. 2, the outlet 8*a* of the accommodation unit 8 and the pocket 9 are aligned in the vertical direction in FIG. 2, and thus it is possible to smoothly supply one pill 10 from the outlet 8*a* to the pocket 9.

In a case where the pocket 9 is present at a position in FIG. 2, an end of the pocket 9 on a side opposite to the accommodation unit 8 side is blocked by a wall portion 1*e* formed in the first housing member 1. The wall portion 1*e* protrudes in the thickness direction of the case main body 12, and extends along the end surface 12*b*.

The extraction port 11 for ejecting the pill 10 in the pocket 9 to the outside of the pill case 100 is formed in the wall portion 1*e*. The extraction port 11 is an opening formed to have a width through which one pill 10 can pass, and is opened to the end surface 12*b*. The extraction port 11 is formed at a position offset to the arrow A direction side (for example, offset to the arrow A direction side by about one pill 10) in relation to the position of the pocket 9 in the state in FIG. 2.

An end 1*c* (FIGS. 2 and 4) on the right side of the rib 1*b* and the left end surface of the reception portion 4*c* (FIG. 4) of the pill ejection button 4 face each other in an approximately parallel manner. The spring (biasing unit) 13 (refer to FIGS. 3B, 4A, and 4B) is interposed between the end 1*c* and the reception portion 4*c*.

The spring 13 is, for example, a compression coil spring, and is disposed between the end 1*c* and the reception portion 4*c* in a compressed state. In this manner, the pill ejection button 4 is biased in the right direction in FIG. 2 by the spring 13. Therefore, in a state in which the child resistance to be described below is released and the pill ejection button 4 is not manipulated to be pressed, the pill ejection button 4 is disposed at the position illustrated in FIG. 2.

When the pill ejection button 4 is pressed in the arrow A direction, the pill ejection button 4 is moved in the arrow A direction against the bias of the spring 13.

In a state in which the pill 10 is accommodated and held in the pocket 9 as in FIG. 2, if the pill ejection button 4 is pressed in the arrow A direction, the facing surface 41 of the pill ejection button 4 presses the pill 10 in the pocket 9 in the arrow A direction.

In this case, the pill 10 in the pocket 9 presses the facing surface 51 of the pill tray 5. Therefore, the pill tray 5 is also moved in the arrow A direction.

Figure 5:
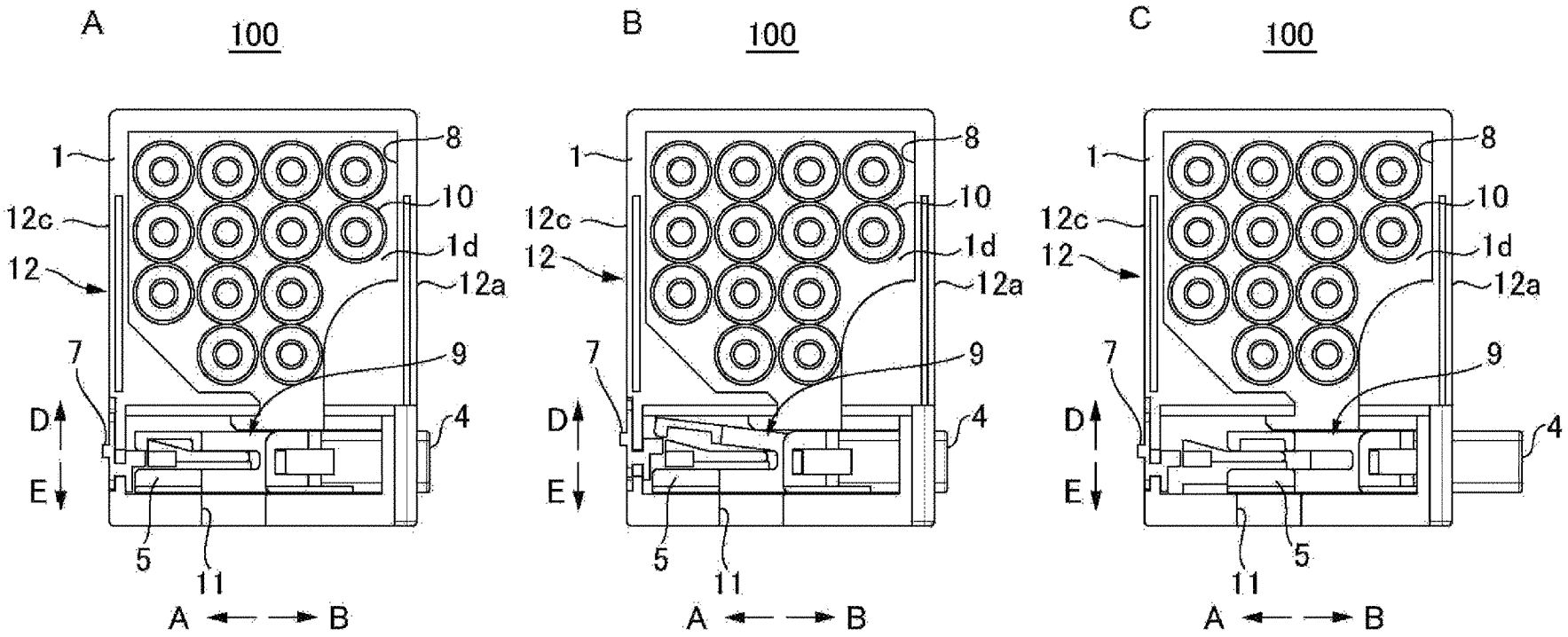
FIG. 5 is a diagram illustrating a flow of an operation of ejecting a pill from the pill case according to the first embodiment.

That is, the pill ejection button 4, the pill 10 in the pocket 9, and the pill tray 5 are integrally moved in the arrow A direction (refer to FIGS. 5B and 5C).

In a case where the pocket 9 is present at a position in FIG. 6C, the pocket 9 is in a state of communicating with the extraction port 11, and thus it is possible to eject the pill 10 in the pocket 9 to the outside through the extraction port 11.

When the pill ejection button 4, the pill 10 in the pocket 9, and the pill tray 5 are moved in the arrow A direction in association with the manipulation of the pill ejection button 4, the side peripheral surface of the pill 10 is pinched with the facing surface 41 and the facing surface 51. However, in a case where the press manipulation to the pill ejection button 4 is released after the pill ejection button 4, the pill 10 in the pocket 9, and the pill tray 5 are moved up to the position in FIG. 5C, the pill ejection button 4 returns to the arrow B direction by the slight clearance due to the bias of the spring 13. In this case, the pill tray 5 is in a state in which the second locking portion 5*d* thereof engages with a locking portion 1*f* to be described below. Therefore, the pill tray 5 does not substantially return to the arrow B direction. Accordingly, the facing interval between the facing surface 41 and the facing surface 51 is slightly increased, and thus the pill 10 is not pinched with the facing surface 41 and the facing surface 51. As a result, it is possible to eject the pill 10 in the pocket 9, by its own weight, to the outside through the extraction port 11.

The pill case 100 includes a returning regulation unit which holds the pill tray 5 when the pill tray 5 is moved in the arrow A direction up to the position illustrated in FIG. 6C.

The returning regulation unit is, for example, the locking portion 1*f* which engages with the second locking portion 5*d* of the pill tray 5. The locking portion 1*f* is formed on the left end of the rib 1*b* in FIG. 2. The locking portion 1*f* is, for example, a protrusion portion which protrudes toward the arrow D direction in FIG. 2. When the pill tray 5 is moved in the arrow A direction up to the position illustrated in FIG. 6C, the locking portion 1*f* engages with the second locking portion 5*d*. According to the engagement between the locking portion 1*f* and the second locking portion 5*d*, the pill tray 5 and the pill ejection button 4 are held by the locking portion 1*f*. In this manner, the movement of the pill tray 5 and the pill ejection button 4 in the arrow B direction according to the bias of the spring 13 is regulated.

Further, the pill case 100 includes a release manipulation unit 7 for the release manipulation of releasing the holding state of the pill tray 5 by the locking portion 1*f*.

The release manipulation unit 7 is provided on a side surface 12*c* of the case main body 12 so as to movable in the arrow E direction and the arrow D direction in FIG. 2 with respect to the case main body 12. The side surface 12*c* is a side surface facing the side surface 12*a*.

The release manipulation unit 7 includes, for example, a manipulation portion 7*b* which is positioned outside the case main body 12 and is manipulated by a user; a releasing portion 7*a* that is positioned inside the case main body 12; and a connection portion 7*c* that connects the manipulation portion 7*b* and the releasing portion 7*a* to each other through the side surface 12*c* of the case main body 12.

In a state in which the second locking portion 5*d* engages with the locking portion 1*f* (FIGS. 6C, 6D, and 5A), when the release manipulation unit 7 is manipulated to be moved in the arrow D direction, the releasing portion 7*a* presses the second locking portion 5*d* in the arrow D direction. In this manner, the spring unit 52 is elastically deformed in the arrow D direction, and thus the engagement between the second locking portion 5*d* and the locking portion 1*f* is released (FIG. 5B).

In this manner, the pill tray 5 and the pill ejection button 4 are moved in the arrow B direction according to the bias of the spring 13, and the pill ejection button 4 and the pill tray 5 return to the position illustrated in FIGS. 5C and 2. In addition, at the time of this returning, the pill tray 5 is moved in the arrow B direction by being pulled by the pill ejection button 4.

Here, since the spring unit 52 of the pill tray 5 presses the second locking portion 5*d* against the rib 1*b*, the pill tray 5 is moved against the frictional force between the second locking portion 5*d* and the rib 1*b*. Accordingly, it is prevented that, after the pill tray 5 returns from the position illustrated in FIG. 5B to the position illustrated in FIGS. 5C and 2, the pill tray 5 is moved in the arrow B direction beyond the position illustrated in FIGS. 5C and 2 due to the remaining force for the return, that is, the width of the pocket 9 becomes narrower than the width illustrated in FIGS. 5C and 2.

Thus, it is possible for the pocket 9 to smoothly receive the next pill 10 after returning to the position in FIGS. 5C and 2.

In a state in which the pill 10 in the pocket 9 cannot be ejected through the extraction port 11 (FIG. 2) before the pill ejection button 4 is manipulated to be moved in the arrow A direction relative to the case main body 12 by a user, an end of the pocket 9 on the arrow E direction side is shielded by the wall portion 1*e*.

That is, the pill case 100 includes a shielding unit (the wall portion 1*e*) which shields the pocket 9 and the accommodation unit 8 from the outside of the pill case 100 in a state in which the pill 10 in the pocket 9 cannot be ejected through the extraction port 11 before the manipulation unit (the pill ejection button 4) is manipulated to be moved. In other words, the wall portion 1*e* shields the inner portion (the pocket 9 and the accommodation unit 8) of the pill case 100 from the outside.

Therefore, it is possible to prevent foreign substances such as dust and dirt from entering the inner portion (the pocket 9 and the accommodation unit 8) of the pill case 100 by the wall portion 1*e*.

In the description below, the position of the pill ejection button 4 illustrated in FIGS. 2, 5C, and 6A is referred to as a first position. The pill ejection button (the first portion) 4 at the first position is in a state of receiving the moving manipulation by a user.

Meanwhile, the position of the pill ejection button 4 illustrated in FIGS. 1B, 5A, 6C, and. 6D is referred to as a second position. The second position is a position after the movement of the pill ejection button 4 by the moving manipulation.

That is, the pill ejection button 4 is movable between the first position and the second position.

In addition, the position of the pill tray 5 illustrated in FIGS. 2, 5C, and 6A is referred to as a third position.

Meanwhile, the position of the pill tray 5 illustrated in FIGS. 1B, 5A, 6C, and 6D is referred to as a fourth position.

That is, the pill tray 5 is movable between the third position and the fourth position.

When the pill tray 5 is at the third position, the pill tray 5 forms the pocket 9 between the pill ejection button 4 at the first position and the pill tray 5.

When the pill tray 5 is at the fourth position, the pill tray 5 forms the pocket 9 between the pill ejection button 4 at the second position and the pill tray 5.

Further, the pill tray 5 is movable relative to the pill ejection button 4.

As illustrated in FIG. 2, when the pill ejection button 4 and the pill tray 5 are respectively at the first position and the third position, it is possible to cause the pill 10 to be received from the accommodation unit 8 into the pocket 9, and the movement of the pill 10 from the pocket 9 to the extraction port 11 is regulated.

Meanwhile, as illustrated in FIG. 6C, when the pill ejection button 4 and the pill tray 5 are respectively at the second position and the fourth position, the pill 10 in the pocket 9 faces the extraction port 11, and the pill 10 can be moved to the extraction port 11.

In a state in which the pill 10 is accommodated in the pocket 9 as illustrated in FIG. 6A, when the pill ejection button 4 is manipulated to be moved to the second position (FIGS. 6B and 6C), the pill tray 5 is pressed by the pill ejection button 4 through the pill 10 to be moved to the fourth position, and the detection sensor 16 (described below) detects that the pill tray 5 is moved up to the fourth position.

Meanwhile, in a state in which the pill 10 is not accommodated in the pocket 9, even when the pill ejection button 4 is manipulated to be moved to the second position, the pill tray 5 is not moved up to the fourth position, and thus the movement of the pill tray 5 is not detected by the detection sensor 16.

That is, the detection sensor 16 detects the ejection of the pill 10 only when the pill 10 is ejected.

Here, the direction of the moving manipulation of the pill ejection button 4 from the first position to the second position and the moving direction of the pill tray 5 from the third position to the fourth position are the same direction (the arrow A direction).

When the pill ejection button 4 is moved from the first position to the second position, the pill ejection button 4, the pill 10 held in the pocket 9, and the pill tray 5 are integrally moved.

Next, the ejection operation of the pill 10 will be described in detail. It is assumed that a plurality of pills 10 are accommodated in advance in the accommodation unit 8 of the pill case 100.

In the initial state, as illustrated in FIG. 5A, the pill ejection button 4 is pressed up to the second position, and the second locking portion 5*d* is locked with the locking portion 1*f*. Thus, the returning of the pill ejection button 4 and the pill tray 5 is regulated. That is, it is a state in which the pill 10 is prevented from being erroneously ejected by a child (a state in which the child resistance function is effective). In this state, since the amount of protrusion of the pill ejection button 4 from the case main body 12 is extremely small, it is simple in design, and the size is compact. Thus, it is suitable for being carried or stored.

When the pill 10 is ejected from the pill case 100, a user manipulates the release manipulation unit 7 in the arrow D direction, and thus the locking state of the second locking portion 5*d* with respect to the locking portion 1*f* is released (FIG. 5B). Then, the pill ejection button 4 and the pill tray 5 are moved in the arrow B direction according to the bias of the spring 13, and are moved (return) to the position (the first position and the second position) illustrated in FIG. 5C.

In the state illustrated in FIG. 5C, the pill ejection button 4 and the pill tray 5 are respectively at the first position and the third position, and the outlet 8*a* of the accommodation unit 8 and the pocket 9 are aligned in the vertical direction in FIG. 5C.

Next, the pill case 100 is inclined such that the pocket 9 is positioned on the lower side than the accommodation unit 8. In this manner, as illustrated in FIG. 6A, one pill 10 is caused to be received into the pocket 9, and the pill 10 is held by the pocket 9. In this case, since the end of the pocket 9 on a side opposite to the accommodation unit 8 side is blocked by the wall portion 1*e*, the falling of the pill 10 from the pocket 9 is regulated.

In the description below, the pill 10 ejected through the ejection operation is referred to as a pill 10*a*. In addition, the pill 10 (subsequent pill 10) which stands by at the outlet 8*a* in succession to the pill 10*a* is referred to as a pill 10*b*.

Next, the pill ejection button 4 is pressed in the arrow A direction (FIG. 6B and FIG. 6C). In this case, the pill ejection button 4, the pill 10*a* in the pocket 9, and the pill tray 5 are integrally moved in the arrow A direction. In this case, since the accommodation unit 8 and the pocket 9 are partitioned by the pill ejection button 4, in a case where the subsequent pill 10*b* is present at the outlet 8*a*, the pill 10*b* is supported by the pill ejection button 4 to be held in the outlet 8*a*.

When the pill ejection button 4 is pressed in the arrow A direction until the pill ejection button 4 and the pill tray 5 respectively reach the second position and the fourth position, the second locking portion 5*d* is engaged with the locking portion 1*f*, and the pill tray 5 and the pill ejection button 4 are held by the locking portion 1*f* (FIG. 6C).

Simultaneously, the pill 10*a* in the pocket 9 faces the extraction port 11, and the pill 10*a* can be moved to the extraction port 11.

Thus, the pill 10*a* is ejected to the outside of the pill case 100 through the extraction port 11. Specifically, the pill 10*a* flows down or falls, by its own weight, from the pocket 9 through the extraction port 11, and is ejected to the outside of the pill case 100 (FIG. 6D).

For example, when a user grips the pill case 100 with one hand, and manipulates to press the pill ejection button 4 in the case main body 12 by using a finger (for example, the thumb or index finger) of the one hand gripping the pill case 100, the pill 10*a* can be ejected to the outside of the pill case 100 with one-hand manipulation. In this case, if the other hand is opened below the extraction port 11 in advance, it is possible to eject the pill 10*a* on the palm of the other hand.

Figure 7:
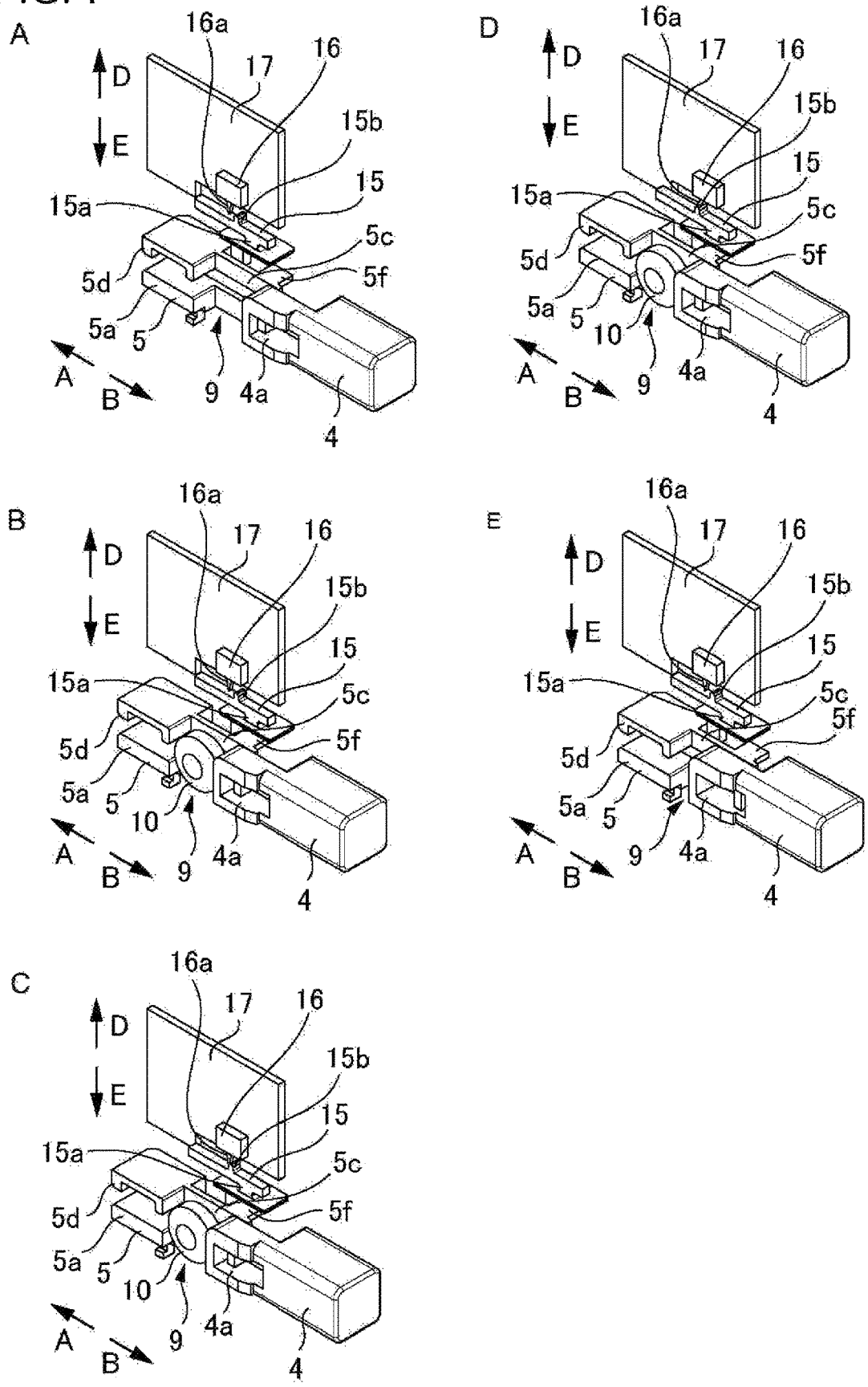
FIG. 7 is a perspective view illustrating a detection operation by a detection unit of the pill case according to the first embodiment.

A mechanism of detecting the ejection of the pill 10 will be described with reference to FIG. 7.

As illustrated in FIG. 7A, the pill case 100 includes the moving member 15 which is moved by being pressed in the arrow A direction by the pill tray 5 when the pill tray 5 is moved in the arrow A direction. The moving member 15 is held by the case main body 12 so as to be movable in the arrow A direction and the arrow B direction relative to the case main body 12.

For example, the moving member 15 includes a first protrusion 15*a* and a second protrusion 15*b*. The first protrusion 15*a* protrudes in the arrow E direction, and the second protrusion 15*b* protrudes in the arrow D direction.

Meanwhile, the pill tray 5 includes a protrusion-shaped pressing portion 5*f* which moves the moving member 15 in the arrow A direction by engaging with the first protrusion 15*a* when being moved in the arrow A direction.

Further, the pill case 100 includes the detection sensor 16 which detects the fact that the pill tray 5 is moved in the arrow A direction up to the fourth position when the pill tray 5 is moved in the arrow A direction up to the fourth position. The detection sensor 16 includes a detection switch 16*a* which is pressed by the second protrusion 15*b* of the moving member 15 when the pill tray 5 is moved in the arrow A direction up to the fourth position. When the detection switch 16*a* is pressed, the detection sensor 16 detects that the pill tray 5 reaches the fourth position, that is, the pill 10*a* is ejected. The detection sensor 16 is provided on, for example, a substrate 17 disposed inside the case main body 12.

Next, a flow of the operation of detecting the ejection of the pill 10*a* by the mechanism illustrated in FIG. 7 in conjunction with the ejection operation of the pill 10 will be described.

First, the state in FIG. 7A is the same as the state illustrated in FIGS. 2 and 5C. From this state, when a user causes the pill 10*a* to be accommodated and held in the pocket 9, and presses the pill ejection button 4, the pill tray 5 is pressed by the pill 10*b* to be moved in the arrow A direction, and then, the pressing portion 5*f* comes in contact with the first protrusion 15*a* (FIG. 7B).

Then, when the pill tray 5 is further moved in the arrow A direction, the second protrusion 15*b* comes in contact with the detection switch 16*a* (FIG. 7C).

Then, the pill tray 5 is further moved in the arrow A direction to reach the fourth position, simultaneously, and the detection switch 16*a* is pressed by the second protrusion 15*b* (FIG. 7D). Accordingly, the detection sensor 16 detects that the pill tray 5 reaches the fourth position, that is, the pill 10*a* is in a state of being ejected.

The state in FIG. 7D corresponds to the state in FIG. 6C.

Meanwhile, in a case where the pill 10 is not accommodated and held in the pocket 9, even when the pill ejection button 4 is moved from the first position to the second position, the pill tray 5 is not pressed by the pill 10, and therefore, the pill tray 5 is not moved to the fourth position (FIG. 7E). Therefore, the detection sensor 16 does not detect that the pill tray 5 reaches the fourth position (the pill 10*a* is in a state of being ejected).

In this manner, the detection sensor 16 detects the ejection of the pill 10 only when the pill 10 is in a state of being ejected.

When the pill ejection button 4 is pressed in a state in which the pill 10 is not accommodated in the pocket 9, the pill tray 5 may be slightly moved in the arrow A direction due to the friction between the first locking portion 5*b* and the slit 4*a*, but the detection sensor 16 does not to detect that the pill tray 5 reaches the fourth position.

Here, the types of the pill 10 accommodated in the accommodation unit 8 of the pill case 100 are not limited, but medicine which is prescribed by a doctor to a patient (user) is exemplified.

For example, the pill case 100 is delivered to the patient in a state in which the pills 10 of which the number corresponds to the content described in the prescription are accommodated in the accommodation unit 8.

The patient ejects the pill 10 by performing the above-described ejection operation at a timing according to the instruction of a doctor, and takes the ejected pill 10.

The pill case 100 can implement an alarm function (notification function) for the prevention of forgetting to take medicine, by utilizing the detection function by the detection sensor 16, or perform recording of pill ejection history information or transmitting the history information to an external device.

In the substrate 17 of the pill case 100, a control circuit, a memory, a communication circuit, a light emitting device such as LED, and the like (none of which is illustrated) are mounted. In addition, the pill case 100 includes a battery 26 (FIG. 3B), which supplies power for operating the control circuit, the memory, the communication circuit, and the light emitting device, in the case main body 12.

In a case where the detection sensor 16 detects the ejection of the pill 10, a detection signal is input to the control circuit, and the control circuit recognizes that. The control circuit performs control the operation of the memory, the communication circuit, and the light emitting device in accordance with the input of the detection signal from the detection sensor 16, and the like.

Hereinafter, an example of the alarm function in a case where the pill 10 is medicine which should be taken one by one in the morning and afternoon will be described.

The alarm is performed by lighting (for example, blinking) the light emitting device such as LED with a predetermined lighting pattern. The alarm operation (notification operation) starts in a case where the ejection of the pill 10 is not detected even when the timing where the pill 10 should be taken has come.

The timing where the pill 10 should be taken is automatically set to the timing where the pill 10 is previously ejected respectively for the morning and afternoon.

For example, in a case where the first pill 10 is ejected from the pill case 100 at 18:00 on the day where the pill 10 is prescribed, the control circuit sets the afternoon medicine-taking timing to 18:00. That is, 18:00 is recorded as the afternoon medicine-taking timing in the memory, and the coming of 18:00 on the next day is monitored.

The alarm relating to the afternoon medicine-taking timing starts in a case where the pill 10 is not ejected even when 18:00 on the next day has come.

When the alarm continues, if the pill 10 is ejected at 18:10, for example, the control circuit stops the alarm operation (light emitting operation), and changes the afternoon medicine-taking timing to 18:10. That is, 18:10 is stored as the afternoon medicine-taking timing in the memory, and the coming of 18:10 on the next day is monitored.

In addition, also in a case where the pill 10 is ejected before the set medicine-taking timing has come, the control circuit sets the ejection timing as the new medicine-taking timing. That is, in a case where the pill 10 is ejected at 17:30, for example, the afternoon medicine-taking timing is changed to 17:30.

In this manner, it is possible to flexibly set the medicine-taking timing in accordance with the change of the rhythm of the patient's life.

The same applies for the morning. For example, in a case where the second pill 10 is ejected from the pill case 100 at 8:00 on the next day of the day where the pill 10 is prescribed, the control circuit sets the morning medicine-taking timing to 8:00.

The alarm relating to the morning medicine-taking timing starts in a case where the pill 10 is not ejected even when 8:00 on the next day has come.

When the alarm continues, if the pill 10 is ejected at 8:15, for example, the control circuit stops the alarm operation, and changes the morning medicine-taking timing to 8:15.

In addition, also in a case where the pill 10 is ejected before the set medicine-taking timing has come, the control circuit sets the ejection timing as the new medicine-taking timing.

In order to suppress the consumption of the battery 26 as much as possible, it is preferable that a predetermined upper limit is set for the continuation time of the alarm. For example, in a case where the continuation time of the alarm is two hours, the alarm is stopped in a case where the pill 10 is not ejected even when 20:10 has come after the alarm starts at 18:10.

The control circuit stores and holds the ejection timing of the pill 10 for each time in the memory. Information (ejection history information) indicating the ejection timing of the pill 10 stored in the memory can be transmitted to an external device through wireless communication or the like. For example, when the patient delivers the pill case 100 to a nurse or a doctor at the time of the next medical examination, and the nurse or the doctor causes a predetermined reading device to read the ejection history information from the pill case 100, it is possible to confirm the ejection history information.

According to the first embodiment described above, the pill case 100 includes the case main body 12 provided with the accommodation unit 8 in which a plurality of pills 10 can be accommodated, the pocket 9 which can receive one pill 10 from the accommodation unit 8, and the extraction port 11 for ejecting the pill 10 in the pocket 9 to the outside.

The pill case 100 further includes the manipulation unit (for example, the pill ejection button 4 and the pill tray 5) which converts a state in which the pill 10 in the pocket 9 cannot be ejected through the extraction port 11 to a state in which the pill 10 in the pocket 9 can be ejected through the extraction port 11 by being manipulated to be moved relative to the case main body 12 by a user; the moving unit (moving member 15) which is moved by indirectly or directly receiving a pressure from the pill 10 in the pocket 9 according to the moving manipulation to the manipulation unit; and the detection unit (detection sensor 16) which detects that the moving unit is moved up to a position of the moving unit which corresponds to a state in which the pill 10 in the pocket 9 can be ejected through the extraction port 11.

Thus, it is possible to eject the pills 10 one by one, and to detect the ejection of the pill 10 when the pill 10 is ejected.

In addition, the manipulation unit presses the pill 10 in the pocket 9 so as to move the pill 10 up to a position at which the pill 10 can be ejected through the extraction port 11, and the moving unit is moved by being pressed by the manipulation unit through at least the pill 10. The direction in which the manipulation unit presses the pill 10, and the direction in which the moving unit is pressed are the same direction (either of which is the arrow A direction). Thus, it is possible to prevent the pill 10 from being rubbed when the pill 10 and the moving unit are moved. Therefore, it is possible to prevent damage such as wear or fragment from generating in the pill 10.

The manipulation unit presses the pill 10 in the pocket 9 so as to move the pill 10 up to a position at which the pill 10 can be ejected through the extraction port 11, and the manipulation unit includes the flat surface (the facing surface 41) which presses the pill 10 in the pocket 9. The direction in which the flat surface presses the pill 10 is a direction orthogonal to the flat surface.

In this manner, since it is possible to prevent the pill 10 from being rubbed by a portion (the facing surface 41) of the manipulation unit which presses the pill 10, it is possible to prevent damage such as wear or fragment from generating in the pill 10.

In more detail, for example, the detection unit includes the detection switch **16*a*, and detects that the moving unit is moved up to a position of the moving unit which corresponds to a state in which the pill 10 in the pocket 9 can be ejected through the extraction port 11 by the detection switch 16*a*** being pressed by the moving unit.

The direction in which the manipulation unit presses the pill 10, and the direction in which the moving unit presses the detection switch **16*a* are the same direction. In this manner, it is possible to prevent the pill 10 from being rubbed when the pill 10 and the moving unit are moved, and thus it is possible to prevent damage such as wear or fragment from generating in the pill 10**.

In addition, the manipulation unit includes the first portion (the pill ejection button 4) which is directly or indirectly manipulated to be moved by a user (for example, which is directly manipulated to be moved), and the second portion (the pill tray 5) which forms the pocket 9 between the first portion and the second portion.

The first portion is movable between the first position at which the moving manipulation is received, and the second position which is a position after the movement by the moving manipulation.

The second portion is movable between the third position at which the pocket 9 is formed between the first portion at the first position and the second portion, and the fourth position at which the pocket 9 is formed between the first portion at the second position and the second portion, and be movable relative to the first portion.

When the first portion and the second portion are respectively at the first position and the third position, it is possible to cause the pill 10 to be received from the accommodation unit 8 into the pocket 9, and the movement of the pill 10 from the pocket 9 to the extraction port 11 is regulated.

Meanwhile, the first portion and the second portion are respectively at the second position and the fourth position, the pill 10 in the pocket 9 faces the extraction port 11, and the pill 10 can be moved to the extraction port 11.

In a state in which the pill 10 is accommodated in the pocket 9, when the first portion is manipulated to be moved to the second position, the second portion is pressed by the first portion through the pill 10 to be moved to the fourth position, and the detection unit detects the movement of the moving unit in association with the movement of the second portion.

However, in a state in which the pill 10 is not accommodated in the pocket 9, even when the first portion is manipulated to be moved to the second position, the second portion is not moved up to the fourth position. Therefore, the movement of the moving unit in association with the movement of the second portion is not detected by the detection unit.

Thus, it is possible to eject the pills 10 one by one from the pill case 100, and to detect the ejection of the pill 10 only when the pill 10 is ejected.

In addition, the direction of the moving manipulation of the first portion from the first position to the second position, and the moving direction of the second portion from the third position to the fourth position are the same direction, and when the first portion is moved from the first position to the second position, the first portion, the pill 10 held in the pocket 9, and the second portion are integrally moved.

Thus, since it is possible to prevent the pill 10 from being rubbed when the first portion, the pill 10 held in the pocket 9, and the second portion are moved, it is possible to prevent damage such as wear or fragment from generating in the pill 10.

In addition, the pill case 100 further includes the biasing unit (the spring 13) which biases the first portion from the second position side toward the first position side.

The first portion and the second portion are connected to each other such that the second portion is moved from the fourth position to the third position in association with the first portion when the first portion is moved from the second position to the first position according to the bias of the biasing unit; however, the second portion is not moved to the fourth position even when the first portion is manipulated to be moved to the second position in a state in which the pill 10 is not accommodated in the pocket 9.

Therefore, it is possible to respectively cause the first portion and the second portion to return to the first position and the second position according to the bias of the biasing unit after the first portion and the second portion are respectively moved to the second position and the fourth position.

Meanwhile, in a state in which the pill 10 is not accommodated in the pocket 9, even when the first portion is moved to the second position, the second portion is not moved to the fourth position. Therefore, the detection unit does not detect the movement of the moving unit in association with the movement of the second portion. Thus, it is possible to detect the ejection of the pill 10 only when the pill 10 is ejected.

The pill case 100 further includes the returning regulation unit (the locking portion 1*f*) which, when the second portion reaches the fourth position, holds the second portion, and regulates the returning of the second portion to the third position and the returning of the first portion to the first position according to the bias of the biasing unit, and the release manipulation unit 7 which performs the release manipulation of releasing the holding state of the second portion by the returning regulation unit.

Therefore, it is possible to prevent the first portion and the second portion from automatically returning to the first position and the third position according to the bias of the biasing unit until the release manipulation unit 7 is manipulated after the pill 10 is ejected.

Thus, for example, it is possible to prevent the pill 10 from being ejected by a child or the like against the user's intention.

That is, it is possible to implement the child resistance (CR) function by using the returning regulation unit and the release manipulation unit 7.

In addition, the returning regulation unit holds the second portion by engaging with the second portion. Thus, it is possible to implement the child resistance (CR) function by a simple configuration.

[Second Embodiment]

Figure 8:
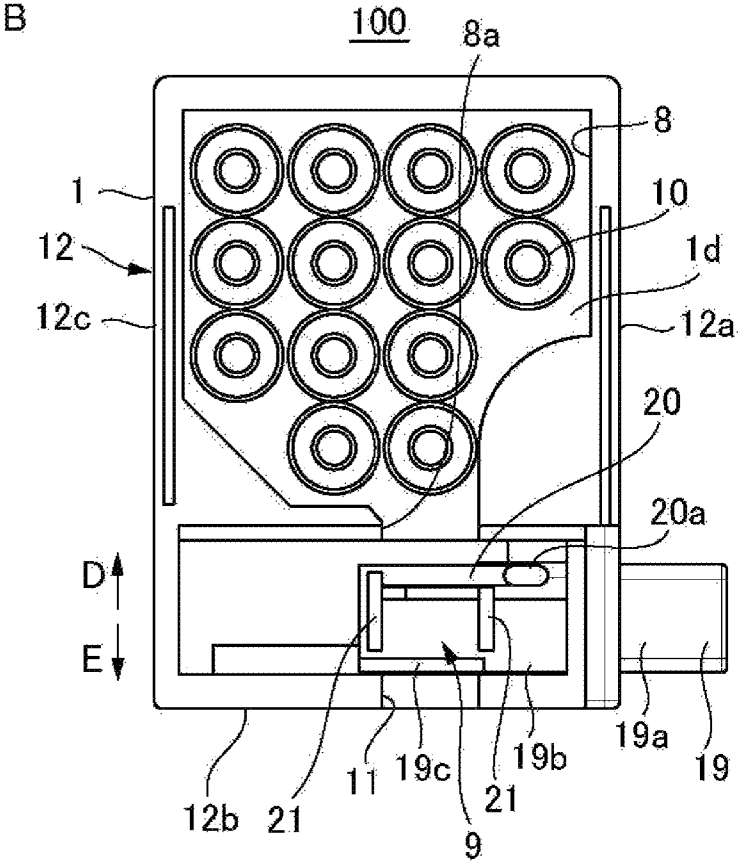
FIG. 8 is a diagram illustrating a pill case according to a second embodiment.
Figure 8:
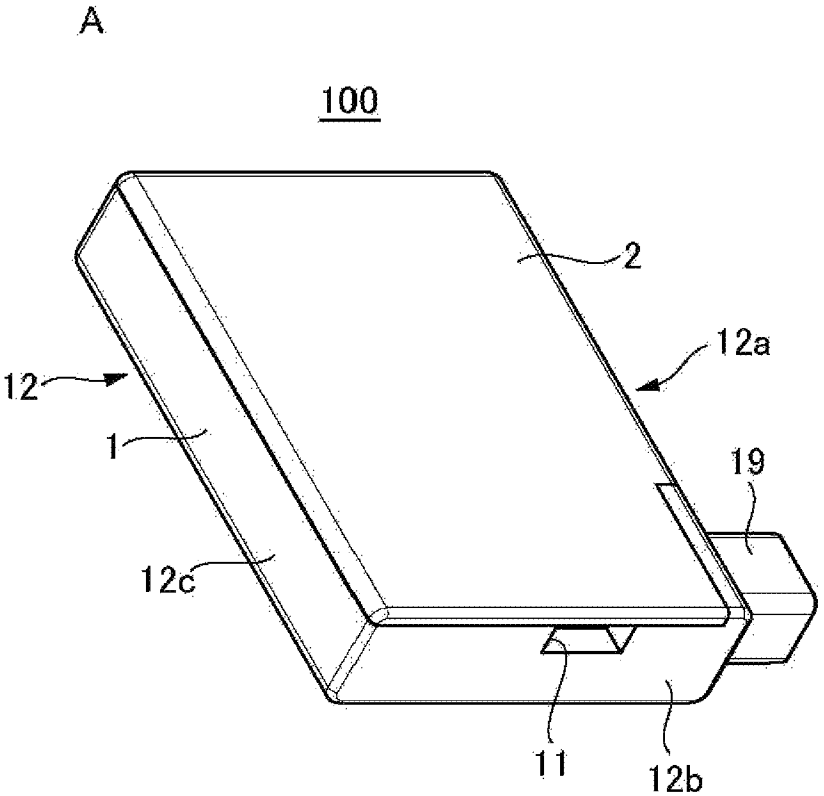

FIG. 8 is a diagram illustrating the pill case 100 according to a second embodiment, FIG. 8A is a perspective view, and FIG. 8B is a plan view. In FIG. 8B, the internal structure of the pill case 100 is illustrated by seeing through the second housing member 2.

FIGS. 9A to 9C and FIGS. 10A to 10C are diagrams illustrating flows of an operation of ejecting a pill 10 from the pill case 100 according to the second embodiment.

The pill case 100 according to this embodiment is different from the pill case 100 according to the above described first embodiment in the points described below, and other points are configured in the same manner as the pill case 100 according to the above described first embodiment.

In the embodiment described above, an example in which the pocket 9 and the pill 10 in the pocket 9 are moved by the ejection manipulation of the pill 10 is described.

In contrast to this, in this embodiment, the pocket 9 is configured not to be moved. By the ejection manipulation of the pill 10, a state in which the pill 10 in the pocket 9 cannot be moved to the extraction port 11 is changed to a state in which the pill 10 in the pocket 9 can be moved to the extraction port 11.

In this embodiment, the pill case 100 does not includes the pill ejection button 4, the pill tray 5, the release manipulation unit 7, and the rib 1*b* (including the locking portion 1*f* or the like).

Instead of those elements, in this embodiment, as illustrated in FIG. 8B, the pill case 100 includes a relative moving unit 19, and a pair of pocket configuring wall portions 21.

The pair of pocket configuring wall portions 21 are flat wall-shaped portions extending in the arrow D direction and the arrow E direction, and face each other in parallel. The pair of pocket configuring wall portions 21 are fixed (for example, integrally formed) to a surface (inner surface) of the second housing member 2 on the first housing member 1 side, and are erect toward the back side in the thickness direction of the case main body 12 (the back side of the paper in FIG. 8B).

The relative moving unit 19 is held by the case main body 12 (for example, held in the first housing member 1) so as to be movable in the arrow A direction and the arrow B direction relative to the case main body 12.

The relative moving unit 19 includes, for example, a flat main body portion 19*b*, a pressed portion 19*a* which is pressed by a user, and a shielding unit 19*c*. In the main body portion 19*b*, the pressed portion 19*a*, the shielding unit 19*c*, and a lever (the moving unit) 20 described below are integrally provided.

The main body portion 19*b* is disposed on the back side of the pair of pocket configuring wall portions 21 (the back side of the paper in FIG. 8B), and a surface of the main body portion 19*b* on the front side is disposed flush with the concave portion 1*d*.

In this embodiment, the pocket 9 is configured of a region surrounded by the pair of pocket configuring wall portions 21, the main body portion 19*b*, and the second housing member 2.

The pressed portion 19*a* is provided on an end of the main body portion 19*b* on the arrow B direction side, and protrudes from the side surface 12*a* of the case main body 12.

The shielding unit 19*c* is erect toward the front side at an end of the main body portion 19*b* on the arrow E direction side. The shielding unit 19*c* is a wall-shaped portion extending in, for example, the arrow A direction and the arrow B direction.

The lever 20 is connected to an end of the main body portion 19*b* on the arrow D direction side of ends thereof on the arrow A direction side. The lever 20 extends in the arrow B direction by a connection portion with respect to the main body portion 19*b*. A pressed portion 20*a* which is erect toward the front side is formed on a tip end (end on the arrow B direction side) of the lever 20. The lever 20 oscillates by being elastically deformed to the arrow D direction side when the pressed portion 20*a* receives a pressure from the pill 10 in the pocket 9. Portions of the lever 20, other than the pressed portion 20*a* are disposed on the same plane with the main body portion 19*b*, and do not interfere with the pill 10 when the pill 10 is moved from the accommodation unit 8 to the pocket 9.

The relative moving unit 19 is biased in the arrow B direction by the spring 13 (not illustrated in FIG. 8 or the like) in the same manner as the case in which the pill ejection button 4 is biased in the arrow B direction in the first embodiment. In a state in which the pressed portion 19*a* is not pressed by a user, the relative moving unit 19 is present at the position illustrated in FIG. 8B. In this state, the pocket 9 is vertically aligned with the outlet 8*a* in FIG. 8B.

Figure 9:
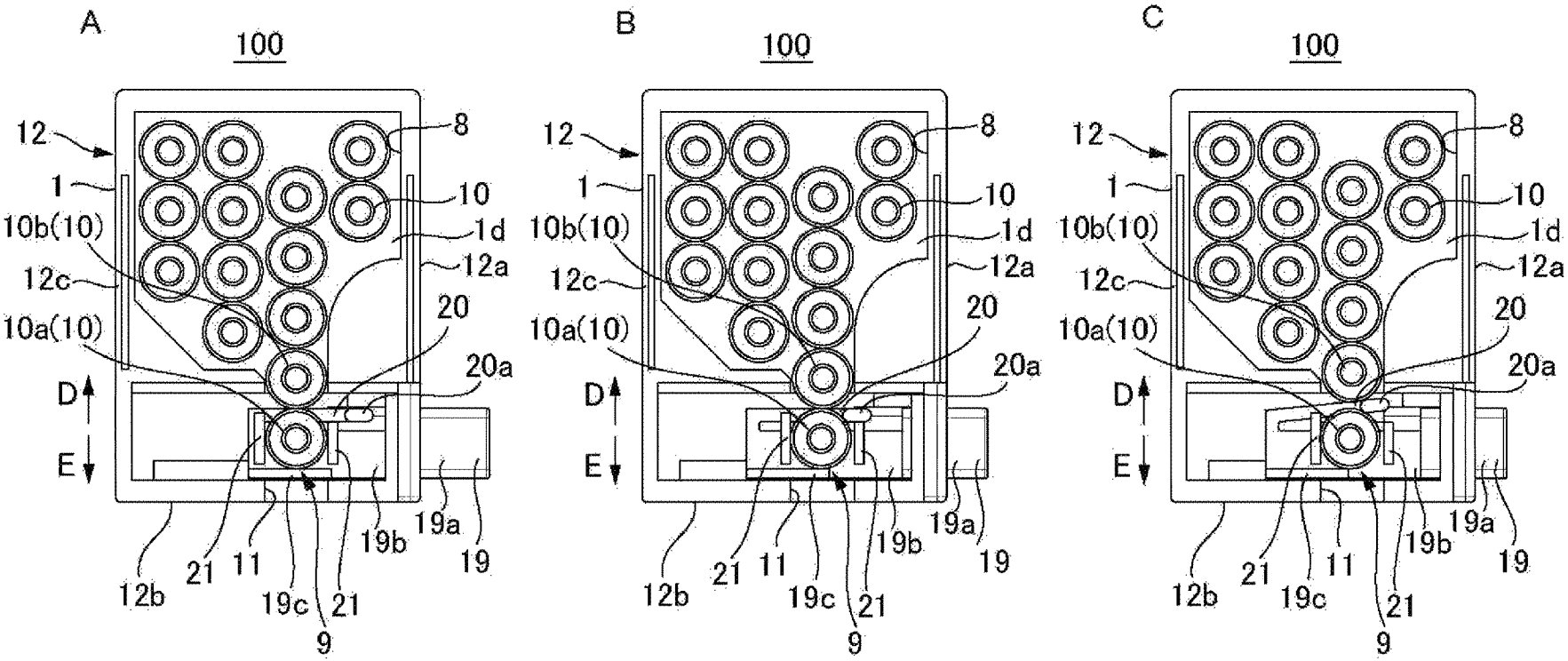
FIG. 9 is a diagram illustrating a flow of an operation of ejecting a pill from the pill case according to the second embodiment.
Figure 10:
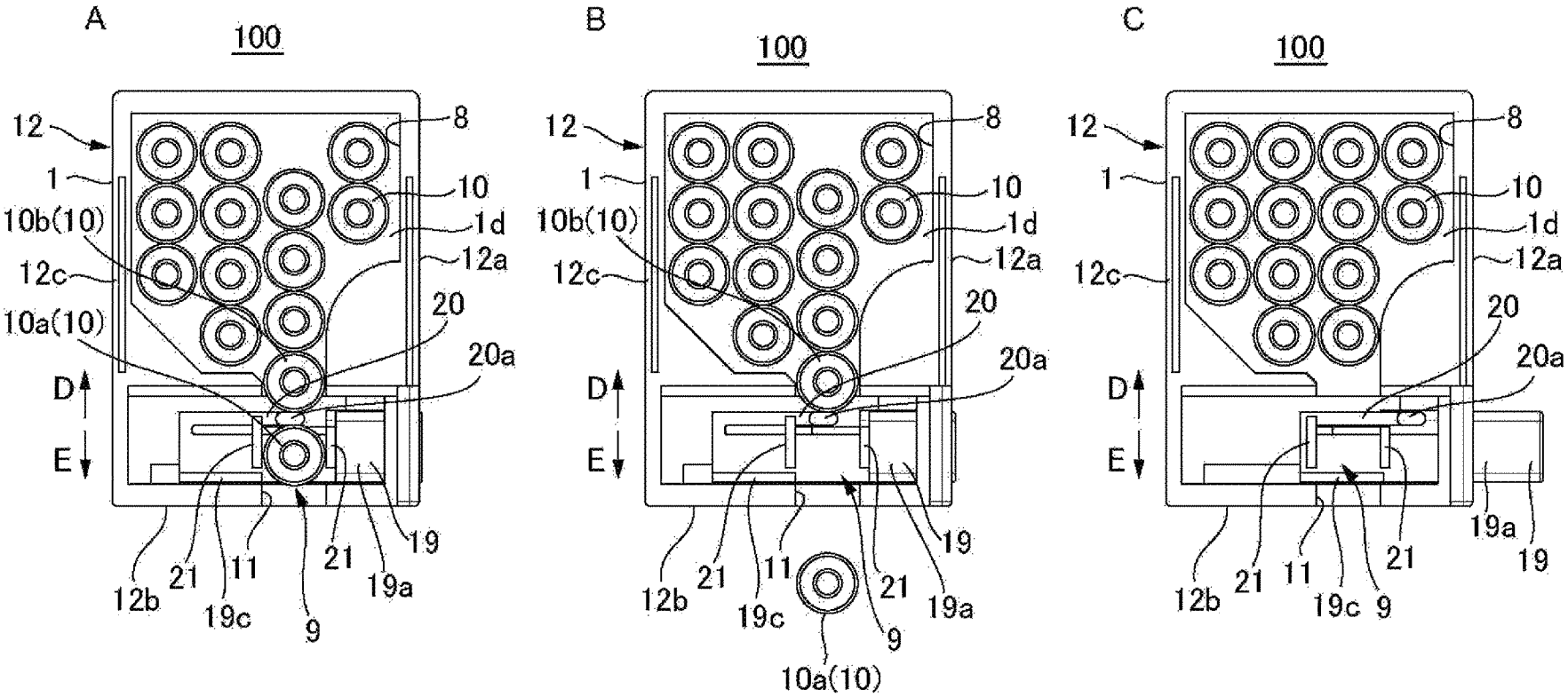
FIG. 10 is a diagram illustrating a flow of an operation of ejecting a pill from the pill case according to the second embodiment.

When the pressed portion 19*a* is manipulated to be pressed in the arrow A direction, the relative moving unit 19 is moved in the arrow A direction against the spring 13 (FIGS. 9B, 9C, and 10A). In addition, when the press manipulation to the pressed portion 19*a* is released, the relative moving unit 19 returns to the position illustrated in FIGS. 10C, 9A, and 8B according to the bias of the spring 13.

In the following description, the position of the relative moving unit 19 illustrated in FIGS. 10C, 9A, and 8B is referred to as a first position. The relative moving unit 19 at the first position is in a state of receiving the moving manipulation by a user.

Meanwhile, the position of the relative moving unit 19 illustrated in FIGS. 10A and 10B is referred to as a second position. The second position is a position after the movement by the moving manipulation to the relative moving unit 19.

That is, the relative moving unit 19 is movable between the first position and the second position relative to the pocket 9.

The first position is a position at which the pill 10 is allowed to be received from the accommodation unit 8 into the pocket 9, and the pocket 9 and the extraction port 11 are shielded from each other by the shielding unit 19*c* of the relative moving unit 19. In other words, when the relative moving unit 19 is at the first position, the pill 10 in the pocket 9 cannot be moved to the extraction port 11.

In this manner, in this embodiment, the end of the pocket 9 on the arrow E direction side is shielded by the shielding unit 19*c* in a state in which the pill 10 in the pocket 9 cannot be ejected through the extraction port 11 (FIG. 8) before the pressed portion 19*a* of the relative moving unit 19 is manipulated to be moved relative to the case main body 12 in the arrow A direction by a user. That is, the pill case 100 includes the shielding unit 19*c* which shields the pocket 9 and the accommodation unit 8 from the outside of the pill case 100 in a state in which the pill 10 in the pocket 9 cannot be ejected through the extraction port 11 before the manipulation unit (the relative moving unit 19) is manipulated to be moved. In other words, the shielding unit 19*c* shields the inner portion (the pocket 9 and the accommodation unit 8) of the pill case 100 from the outside. Therefore, it is possible to prevent foreign substances such as dust and dirt from entering the inner portion (the pocket 9 and the accommodation unit 8) of the pill case 100 by the shielding unit 19*c*.

The second position is a position at which the accommodation unit 8 and the pocket 9 are shielded from each other by the relative moving unit 19, the pill 10 in the pocket 9 faces the extraction port 11, and the pill 10 can be moved to the extraction port 11.

In this embodiment, in a state in which the pill 10 is accommodated in the pocket 9, when the relative moving unit 19 is moved from the first position to the second position, the pressed portion 20*a* of the lever 20 is pressed by the pill 10, and thus the lever 20 oscillates. In this embodiment, the detection sensor 16 is disposed to detect the oscillation of the lever 20.

Meanwhile, in a state in which the pill 10 is not accommodated in the pocket 9, even when the relative moving unit 19 is moved from the first position to the second position, the lever 20 is not pressed by the pill 10, and the lever 20 does not oscillate. Therefore, the detection sensor 16 does not to detect the oscillation.

Hereinafter, the ejection operation of the pill 10 in this embodiment will be described.

First, in the state illustrated in FIG. 8B, the relative moving unit 19 is at the first position, and the outlet 8*a* of the accommodation unit 8 and the pocket 9 are aligned in the vertical direction in FIG. 8B.

Next, the pill case 100 is inclined such that the pocket 9 is positioned on the lower side than the accommodation unit 8. In this manner, as illustrated in FIG. 9A, one pill 10*a* is caused to be received into the pocket 9, and the pill 10*a* is held by the pocket 9. In this case, since the end of the pocket 9 on a side opposite to the accommodation unit 8 side is blocked by the shielding unit 19*c* of the relative moving unit 19, the falling of the pill 10 from the pocket 9 is regulated.

Next, when the pressed portion 19*a* is pressed in the arrow A direction, the entirety of the relative moving unit 19 is moved in the arrow A direction (FIGS. 9B and 9C). In this case, the pocket 9 and the outlet 8*a* are partitioned by the pressed portion 20*a*, and the pressed portion 20*a* is pressed by the pill 10*a* and oscillates above in FIG. 9C. The subsequent pill 10*b* is supported by the pressed portion 20*a* to be held in the outlet 8*a*.

In a state in which the relative moving unit 19 reaches the second position, the shielding unit 19*c* which was shielding the pocket 9 and the extraction port 11 from each other until then, is in a state of being moved further on the arrow A direction side than the extraction port 11. That is, the pocket 9 and the extraction port 11 communicate with each other, the pill 10*a* in the pocket 9 can be ejected to the outside of the pill case 100 through the extraction port 11 (FIG. 10A). Thus, the pill 10*a* is ejected, by its own weight, to the outside of the pill case 100 (FIG. 10B).

In a case where the press manipulation to the pressed portion 19*a* is released, the relative moving unit 19 is moved in the arrow B direction according to the bias of the spring 13, and returns to the first position (FIG. 10C).

According to the second embodiment described above, the manipulation unit includes the relative moving unit 19 which is moved from the first position to the second position relative to the pocket 9 by the moving manipulation. In addition, the moving unit is the lever 20 which is provided to the relative moving unit so as to oscillate with respect to the relative moving unit 19.

The first position is a position at which the pill 10 is allowed to be received from the accommodation unit 8 into the pocket 9, and the pocket 9 and the extraction port 11 are shielded from each other by the relative moving unit 19. The second position is a position after the movement by the moving manipulation, where the accommodation unit 8 and the pocket 9 are shielded from each other by the relative moving unit 19, the pill 10 in the pocket 9 faces the extraction port 11, and the pill 10 can be moved to the extraction port 11.

In a state in which the pill 10 is accommodated in the pocket 9, when the relative moving unit 19 is moved from the first position to the second position, the lever 20 is pressed by the pill 10 to oscillate, and the oscillation is detected by the detection sensor 16.

Meanwhile, in a state in which the pill 10 is not accommodated in the pocket 9, even when the relative moving unit 19 is moved from the first position to the second position, the lever 20 does not oscillate, and therefore, the detection sensor 16 does not detect the oscillation.

Thus, it is possible to eject the pills 10 one by one, and to detect the ejection of the pill 10 only when the pill 10 is ejected.

In the second embodiment, an example in which the detection sensor 16 detects the oscillation of the lever 20 is described. However, the detection sensor 16 may detect that the main body portion 19*b* of the relative moving unit 19 is moved up to the position (the second position) in FIG. 10A.

[Third Embodiment]

Figure 11:
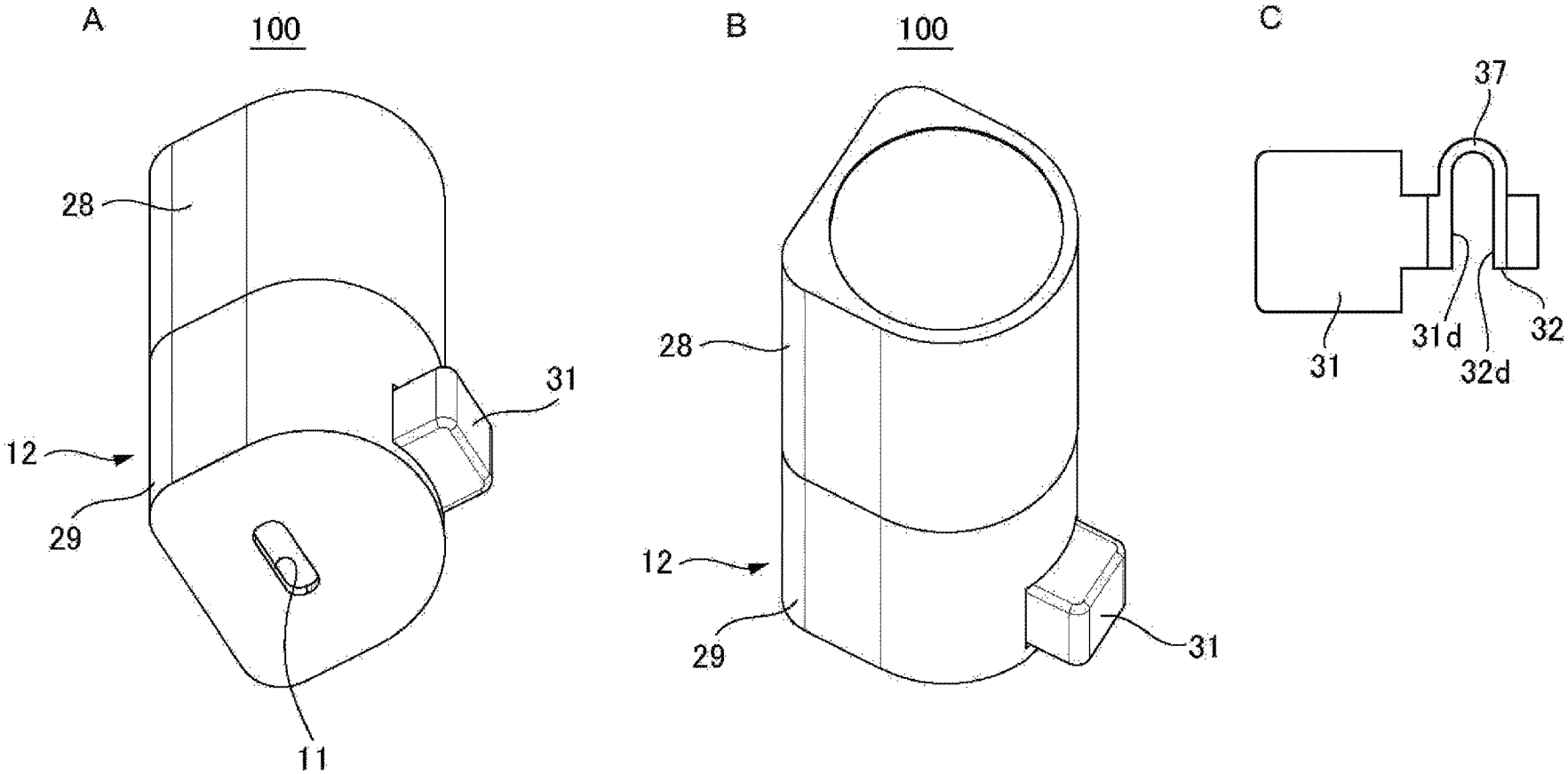
FIG. 11 is a diagram illustrating a pill case according to a third embodiment.

FIG. 11 is a diagram illustrating the pill case 100 according to a third embodiment, FIGS. 11A and 11B are perspective views of the pill case 100, and FIG. 11C is a plan view of the manipulation member (formed of a pill ejection button 31, a second portion 32, and a connection portion 37).

FIGS. 12A to 12D are diagrams illustrating a flow of an operation of ejecting the pill 10 from the pill case 100 according to the third embodiment.

The pill case 100 according to this embodiment is formed in a cylindrical shape. In this embodiment, the case main body 12 is formed in a cylindrical shape by assembling a plurality of members including a first housing member 28 and a second housing member 29.

The first housing member 28 and the second housing member 29 are formed in a cylindrical shape in which one end is an opening end, and the other end is blocked.

Figure 12:
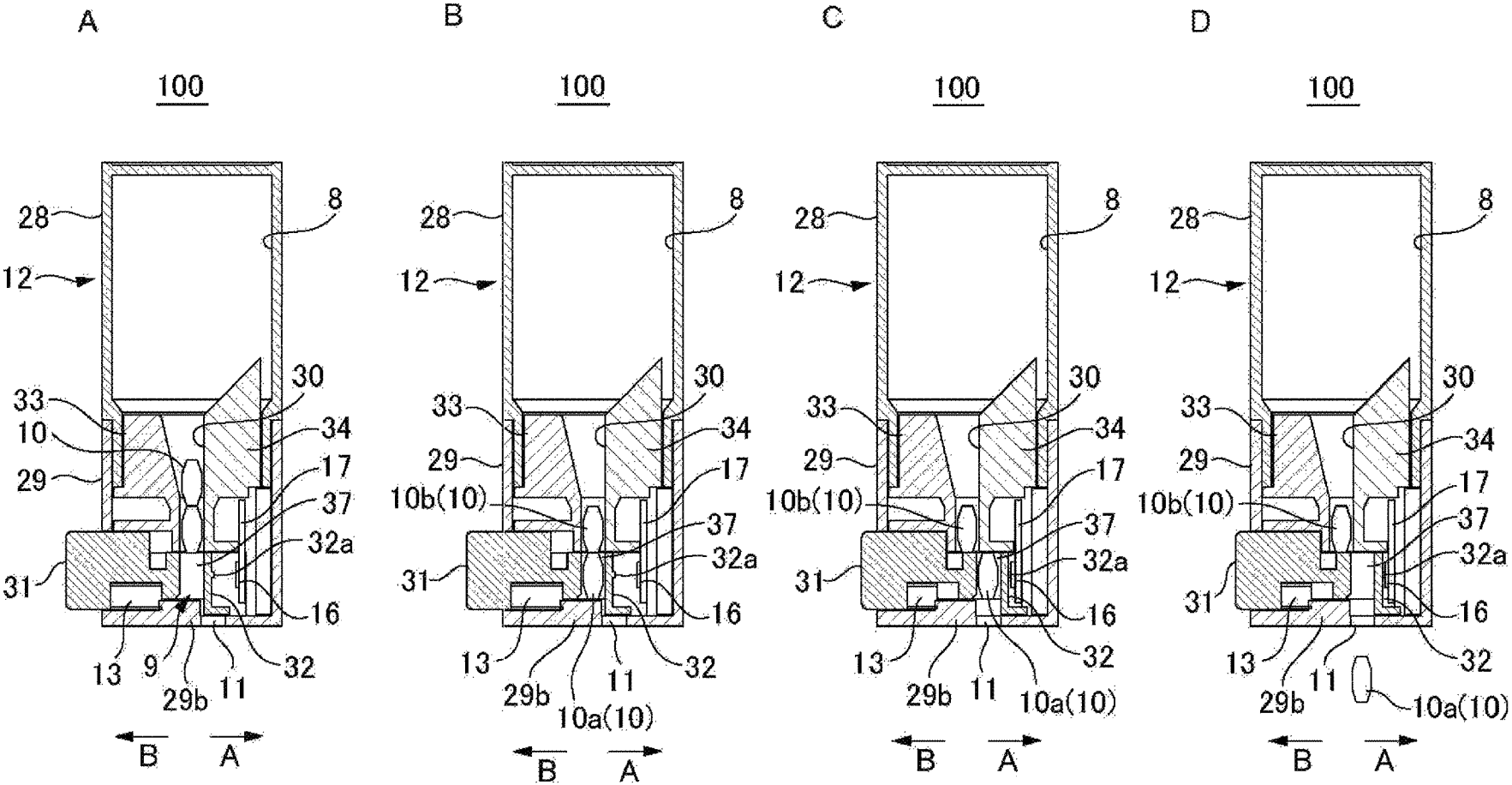
FIG. 12 is a diagram illustrating a flow of an operation of ejecting a pill from the pill case according to the third embodiment.

As illustrated in FIG. 12A, for example, an end of the first housing member 28 on the opening end side is formed to have a diameter smaller than other portions of the first housing member 28, the end is inserted into the second housing member 29 through the opening end of the second housing member 29, and the first housing member 28 and the second housing member 29 are assembled.

The cylindrical-shaped accommodation unit 8 is formed by the internal space of the first housing member 28.

Meanwhile, the extraction port 11 is formed on a blocked end 29*b* of the second housing member 29.

A first path configuring member 33 and a second path configuring member 34 are provided in the second housing member 29, and a path 30 which communicates with the accommodation unit 8 is formed between the first path configuring member 33 and the second path configuring member 34. The pill 10 in the accommodation unit 8 is guided to the pocket 9, which will be described below, through the path 30.

The second housing member 29 is further provided with the manipulation member which includes the pill ejection button (the first portion) 31, the second portion 32, and the flexible connection portion 37 which connects the pill ejection button 31 and the second portion 32 to each other. The pill ejection button 31, the second portion 32, and the connection portion 37 are integrally formed by using a resin material with appropriate elastic modulus such that the connection portion 37 has flexibility (FIG. 11C).

An opposite interval between the pill ejection button 31 and the second portion 32 is variable when the connection portion 37 is bent.

In this embodiment, the pocket 9 is configured by a space between the pill ejection button 31 and the second portion 32.

A surface (a facing surface 31*d*) of the pill ejection button 31, which faces the second portion 32, and a surface (a facing surface 32*d*) of the second portion 32, which faces the pill ejection button 31, are respectively flat surfaces, and face each other in parallel.

In the first and second embodiments described above, an example in which the side peripheral surface of the pill 10 is pinched when the pill 10 in the pocket 9 is moved is described, but in this embodiment, front and back surfaces of the pill 10 are pinched.

Here, the sectional area of the path 30 is reduced from the accommodation unit 8 side to the pocket 9 side. In addition, in the state in FIG. 12A, the sectional area of a portion, which is adjacent to the pocket 9, of the path 30 is set to be equal to the sectional area of the pocket 9. Therefore, the pill 10 which is accommodated in the accommodation unit 8 with a random posture flows down by being guided by the path 30, and thus the posture of the pill 10 is corrected to a posture when being accommodated in the pocket 9.

Some parts of the pill ejection button 31 are accommodated in the inner portion of the second housing member 29, and the other parts protrude to the outside of the second housing member 29 from the side surface of the second housing member 29. The pill ejection button 31 is supported by the second housing member 29 so as to be movable relative to the second housing member 29 in the arrow A direction and the arrow B direction in FIG. 12A.

The pill ejection button 31 is configured such that the part, which protrudes to the outside of the second housing member 29, can be manipulated to be pressed into the second housing member 29 (toward the arrow A direction in FIG. 12A). The pill ejection button 31 is biased by the spring 13 in a direction opposite to the direction in which the press manipulation is performed, and the press manipulation of the pill ejection button 31 is performed against the bias of the spring 13.

The pill ejection button 31 can be manipulated to be pressed from the first position illustrated in FIGS. 12A and 12B up to the second position illustrated in FIGS. 12C and 12D.

The second portion 32 is accommodated in the inner portion of the second housing member 29. The second portion 32 is supported by the second housing member 29 so as to be movable relative to the second housing member 29 in the arrow A direction and the arrow B direction in a state of facing the pill ejection button 31 in parallel.

In a state in which the pill 10 is accommodated in the pocket 9, when the pill ejection button 31 is manipulated to be pressed, the second portion 32 is pressed in the arrow A direction by the pill 10, and the second portion 32 is moved from the third position illustrated in FIGS. 12A and 12B up to the fourth position illustrated in FIGS. 12C and 12D.

In addition, the substrate 17 is provided in the second housing member 29, and the detection sensor 16 or the like is provided on the substrate 17. The substrate 17 is disposed further on the arrow B direction side than the second portion 32, and faces the second portion 32. The detection sensor 16 is, for example, a magnetic sensor, and detects that a detection target unit (the moving unit) 32*a* provided in the second portion 32 approaches the detection sensor 16 up to the position illustrated in FIGS. 12C and 12D when the detection target unit 32*a* approaches the detection sensor 16 up to the position. In this embodiment, the moving unit is not separated from the second portion 32, and the detection target unit 32*a* as a part of the second portion 32 is the moving unit.

In this embodiment, in a state in which the pill 10 in the pocket 9 cannot be ejected through the extraction port (FIG. 12A) before the pill ejection button 31 is manipulated to be moved in the arrow A direction relative to the case main body 12 by a user, an end of the pocket 9 on a side opposite to the path 30 and the accommodation unit 8 side (an end on the lower side in FIG. 12A) is shielded by the blocked end 29*b* of the second housing member 29.

That is, the pill case 100 includes the shielding unit (the end 29*b*) which shields the pocket 9 and the accommodation unit 8 from the outside of the pill case 100 in a state in which the pill 10 in the pocket 9 cannot be ejected through the extraction port 11 before the manipulation unit (the pill ejection button 31) is manipulated to be moved. In other words, the end 29*b* shields the inner portion (the pocket 9 and the accommodation unit 8) of the pill case 100 from the outside.

Therefore, it is possible to prevent foreign substances such as dust and dirt from entering the inner portion (the pocket 9 and the accommodation unit 8) of the pill case 100 by the end 29*b*.

Hereinafter, the operations in this embodiment will be described.

First, the posture of the pill case 100 is adjusted such that the pocket 9 is positioned on the lower side than the accommodation unit 8 (FIG. 12A). In this manner, as illustrated in FIG. 12B, one pill 10*a* is received into the pocket 9 through the path 30, and the pill 10*a* is held by the pocket 9. In this case, the end of the pocket 9 on a side opposite to the accommodation unit 8 side is blocked by the end surface of the second housing member 29, and the falling of the pill 10 from the pocket 9 is regulated.

Next, the pill ejection button 31 is pressed in the arrow A direction (FIGS. 12C and 12D). In this case, the pill ejection button 31, the pill 10*a* in the pocket 9, and the second portion 32 are integrally moved in the arrow A direction. Since both the surfaces of the pill 10*a* of the pocket 9 in the thickness direction are pinched with the facing surfaces 31*d* and 32*d* (FIG. 11C), damage on the pill 10*a* is preferably suppressed.

In this case, since the path 30 and the pocket 9 are partitioned by the pill ejection button 31, the subsequent pill 10*b* is supported by the pill ejection button 31 to be held in the path 30.

When the pill ejection button 31 is pressed in the arrow A direction until the pill ejection button 31 and the second portion 32 respectively reach the second position and the fourth position, the pill 10*a* in the pocket 9 is faces the extraction port 11. In this case, the movement of the second portion 32 to the fourth position is detected by the detection sensor 16. When the press manipulation to the pill ejection button 31 is released, the pill 10*a* flows down or falls, by its own weight, from the pocket 9 through the extraction port 11, and is ejected to the outside of the pill case 100 (FIG. 12D).

Thereafter, the pill ejection button 31 returns to the first position (refer to FIGS. 12A and 12B) according to the bias of the spring 13. In this case, the second portion 32 returns to the third position (refer to FIGS. 12A and 12B) by being pulled by the pill ejection button 31 through the connection portion 37.

In addition, in a state in which the pill 10 is not accommodated in the pocket 9, even when the pill ejection button 31 is manipulated to be moved to the second position, the connection portion 37 is bent and the opposite interval between the pill ejection button 31 and the second portion 32 is reduced so that the second portion 32 is not moved up to the fourth position. Therefore, the movement of the detection target unit 32*a* in association with the movement of the second portion 32 is not detected by the detection sensor 16.

The same effect as the first embodiment can be obtained even in the third embodiment.

That is, the pill case 100 includes the case main body 12 provided with the accommodation unit 8 in which a plurality of pills 10 can be accommodated, the pocket 9 which can receive one pill 10 from the accommodation unit 8, and the extraction port 11 for ejecting the pill 10 in the pocket 9 to the outside.

The pill case 100 further includes the manipulation unit (for example, the pill ejection button 31 and the second portion 32) which converts a state in which the pill 10 in the pocket 9 cannot be ejected through the extraction port 11 to a state in which the pill 10 in the pocket 9 can be ejected through the extraction port 11 by being manipulated to be moved relative to the case main body 12 by a user; the moving unit (the detection target unit 32*a*) which is moved by indirectly or directly receiving a pressure from the pill 10 in the pocket 9 according to the moving manipulation to the manipulation unit; and the detection unit (detection sensor 16) which detects that the moving unit is moved up to a position of the moving unit which corresponds to a state in which the pill 10 in the pocket 9 can be ejected through the extraction port 11.

Thus, it is possible to eject the pills 10 one by one, and to detect the ejection of the pill 10 when the pill 10 is ejected.

In addition, the manipulation unit presses the pill 10 in the pocket 9 so as to move the pill 10 up to a position at which the pill 10 can be ejected through the extraction port 11, and the moving unit is moved by being pressed by the manipulation unit through at least the pill 10. The direction in which the manipulation unit presses the pill 10, and the direction in which the moving unit is pressed are the same direction (either of which is the arrow A direction). Thus, it is possible to prevent the pill 10 from being rubbed when the pill 10 and the moving unit are moved. Therefore, it is possible to prevent damage such as wear or fragment from generating in the pill 10.

The manipulation unit presses the pill 10 in the pocket 9 so as to move the pill 10 up to a position at which the pill 10 can be ejected through the extraction port 11, and the manipulation unit includes the flat surface (the facing surface 31*d*) which presses the pill 10 in the pocket 9. The direction in which the flat surface presses the pill 10 is a direction orthogonal to the flat surface.

In this manner, since it is possible to prevent the pill 10 from being rubbed by a portion (the facing surface 31*d*) of the manipulation unit which presses the pill 10, it is possible to prevent damage such as wear or fragment from generating in the pill 10.

In addition, the manipulation unit includes the first portion (the pill ejection button 31) which is directly or indirectly manipulated to be moved by a user, and the second portion 32 which forms the pocket 9 between the first portion and the second portion 32.

The first portion is movable between the first position at which the moving manipulation is received, and the second position which is a position after the movement by the moving manipulation.

The second portion 32 is movable between the third position at which the pocket 9 is formed between the first portion at the first position and the second portion 32, and the fourth position at which the pocket 9 is formed between the first portion at the second position and the second portion 32, and be movable relative to the first portion.

When the first portion and the second portion 32 are respectively at the first position and the third position, it is possible to cause the pill 10 to be received from the accommodation unit 8 into the pocket 9, and the movement of the pill 10 from the pocket 9 to the extraction port 11 is regulated.

When the first portion and the second portion 32 are respectively at the second position and the fourth position, the pill 10 in the pocket 9 faces the extraction port 11, and the pill 10 can be moved to the extraction port 11.

In a state in which the pill 10 is accommodated in the pocket 9, when the first portion is manipulated to be moved to the second position, the second portion 32 is pressed by the first portion through the pill 10 to be moved to the fourth position, and the detection sensor 16 detects the movement of the moving unit in association with the movement of the second portion 32.

However, in a state in which the pill 10 is not accommodated in the pocket 9, even when the first portion is manipulated to be moved to the second position, the second portion 32 is not moved up to the fourth position. Therefore, the movement of the moving unit in association with the movement of the second portion 32 is not detected by the detection unit.

Thus, it is possible to eject the pills 10 one by one from the pill case 100, and to detect the ejection of the pill 10 only when the pill 10 is ejected.

In addition, the direction of the moving manipulation of the first portion from the first position to the second position, and the moving direction of the second portion 32 from the third position to the fourth position are the same direction, when the first portion is moved from the first position to the second position, the first portion, the pill 10 held in the pocket 9, and the second portion 32 are integrally moved.

Thus, since it is possible to prevent the pill 10 from being rubbed when the first portion, the pill 10 held in the pocket 9, and the second portion 32 are moved, it is possible to prevent damage such as wear or fragment from generating in the pill 10.

In addition, the pill case 100 further includes the biasing unit (the spring 13) which biases the first portion from the second position side toward the first position side.

The first portion and the second portion 32 are connected to each other such that the second portion 32 is moved from the fourth position to the third position in association with the first portion when the first portion is moved from the second position to the first position according to the bias of the biasing unit; however, the second portion 32 is not moved to the fourth position even when the first portion is manipulated to be moved to the second position in a state in which the pill 10 is not accommodated in the pocket 9.

Therefore, it is possible to respectively cause the first portion and the second portion 32 to return to the first position and the second position according to the bias of the biasing unit after the first portion and the second portion 32 are respectively moved to the second position and the fourth position.

Meanwhile, in a state in which the pill 10 is not accommodated in the pocket 9, even when the first portion is moved to the second position, the second portion 32 is not moved to the fourth position. Therefore, the detection unit does not detect the movement of the moving unit in association with the movement of the second portion 32. Thus, it is possible to detect the ejection of the pill 10 only when the pill 10 is ejected.

In addition, the pill case 100 is configured such that the first portion and the second portion 32 are connected to each other through the flexible connection portion 37; in a state in which the pill 10 is not accommodated in the pocket 9, if the first portion is manipulated to be moved to the second position, the connection portion 37 is deformed so that a distance between the first portion and the second portion 32 is reduced; the second portion 32 is not moved up to the fourth position; and the movement of the moving unit in association with the movement of the second portion 32 is not detected by the detection unit. Thus, it is possible to easily implement the configuration of detecting the ejection of the pill 10 only when the pill 10 is ejected.

Meanwhile, when the first portion is moved from the second position to the first position in a state in which the second portion 32 is at the fourth position, the first portion pulls the second portion 32 through the connection portion 37 so that the second portion 32 is moved from the fourth position to the third position. Thus, it is possible to cause the second portion 32 to return to the third position in conjunction with the operation of the first portion returning to the first position.

Also in this embodiment, the detection sensor 16 may be a sensor of a type having the detection switch 16*a* in the same manner as the first embodiment, instead of the magnetic sensor.

In addition, even in this embodiment, similar to the first embodiment, it is preferable to include the returning regulation unit and the release manipulation unit.

[Fourth Embodiment]

Figure 13:
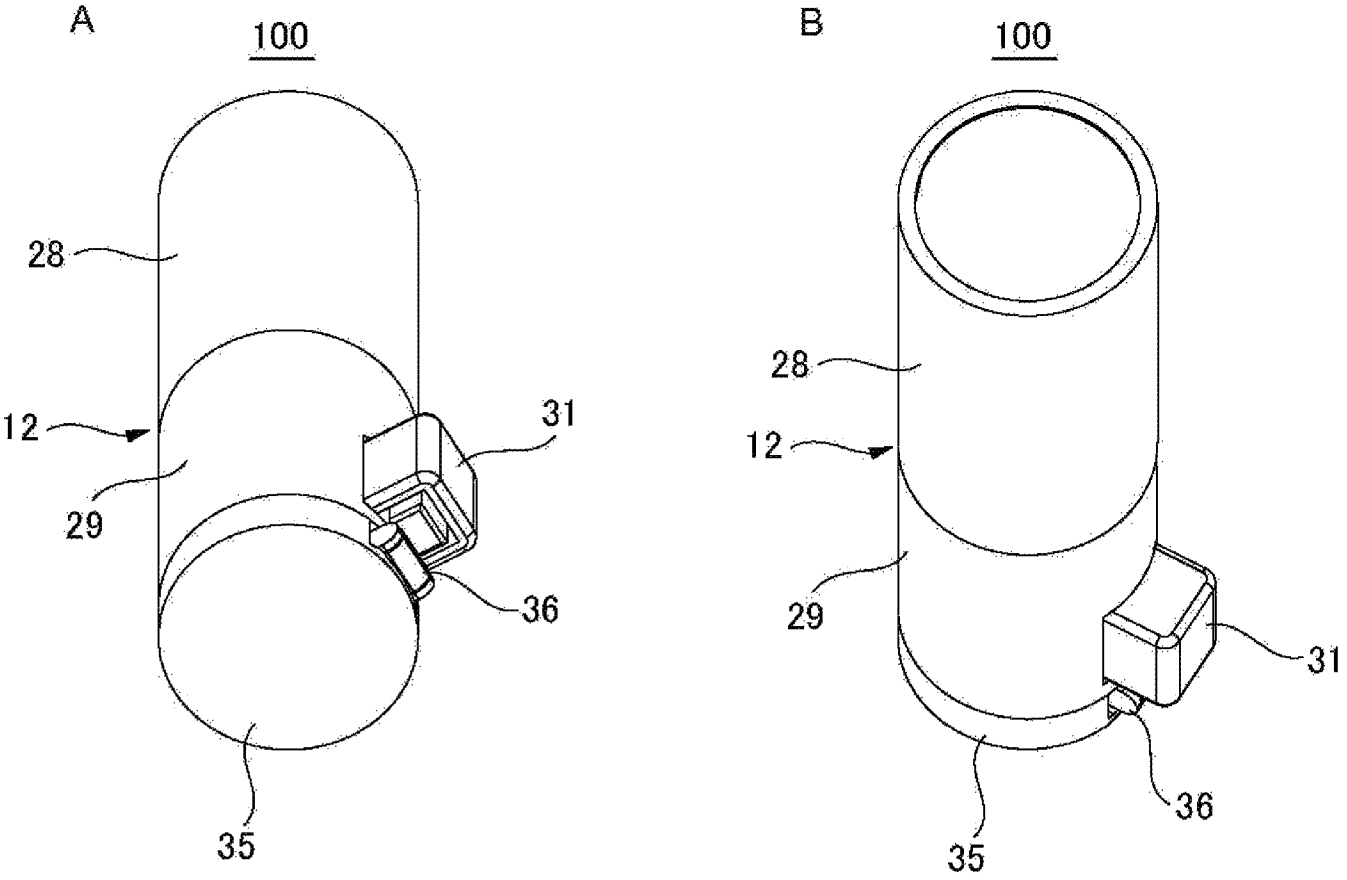
FIG. 13 is a perspective view illustrating a pill case according to a fourth embodiment.

FIG. 13 is a perspective view illustrating the pill case 100 according to a fourth embodiment.

FIGS. 14A to 14D are diagrams illustrating a flow of an operation of ejecting a pill 10 from the pill case 100 according to the fourth embodiment.

The pill case 100 according to this embodiment is different from the pill case 100 according to the above described third embodiment in the points described below, and other points are configured in the same manner as the pill case 100 according to the above described third embodiment.

In this embodiment, the pill case 100 includes an opening and closing lid 35 which can be converted to a state (first state) of blocking the extraction port 11, and a state (second state) of causing the extraction port 11 to communicate with the outside. That is, the opening and closing lid 35 is shaft-supported by the shaft support unit 36 with respect to the second housing member 29, and can be converted to a state (first state) of covering the blocked end of the second housing member 29, and a state (second state) of not covering the end.

The opening and closing lid 35 includes a disk-shaped main body portion 35*a* that can cover the blocked end of the second housing member 29, a supported portion 35*b* which is shaft-supported by the shaft support unit 36, and a hook-shaped locking portion 35*c* which is formed on an end of the main body portion 35*a* on a side opposite to the supported portion 36*b*.

A to-be-locked portion 29*a* with which the locking portion 35*c* is locked in a state in which the opening and closing lid 35 is closed is formed in the second housing member 29. When the locking portion 35*c* is locked with the to-be-locked portion 29*a*, the opening and closing lid 35 is maintained to be in a closed state (first state).

In addition, the second portion 32 includes a locking releasing portion 32*c* which protrudes in the arrow A direction. When the second portion 32 is moved to the fourth position illustrated in FIGS. 14C and 14D, the locking releasing portion 32*c* bats the locking portion 35*c* in the arrow A direction so as to release the locking state of the locking portion 35*c* with respect to the to-be-locked portion 29*a*.

In addition, the pill case 100 may include a biasing unit such as a torsion spring (not illustrated) which biases the opening and closing lid 35 in an opening direction. In this case, when the locking state of the locking portion 35*c* with respect to the to-be-locked portion 29*a* is released, the opening and closing lid 35 is biased by the biasing unit to be opened (to be in second state).

Also in this embodiment, in a state in which the pill 10 in the pocket 9 cannot be ejected through the extraction port 11 (FIG. 14A) before the pill ejection button 31 is manipulated to be moved in the arrow A direction relative to the case main body 12 by a user, an end of the pocket 9 on a side opposite to the path 30 and the accommodation unit 8 side (an end on the lower side in FIG. 14A) is shielded by the blocked end 29*b* of the second housing member 29.

That is, the pill case 100 includes the shielding unit (the end 29*b*) which shields the pocket 9 and the accommodation unit 8 from the outside of the pill case 100 in a state in which the pill 10 in the pocket 9 cannot be ejected through the extraction port 11 before the manipulation unit (the pill ejection button 31) is manipulated to be moved. In other words, the end 29*b* shields the inner portion (the pocket 9 and the accommodation unit 8) of the pill case 100 from the outside.

Therefore, it is possible to prevent foreign substances such as dust and dirt from entering the inner portion (the pocket 9 and the accommodation unit 8) of the pill case 100 by the end 29*b*.

Hereinafter, the operations in this embodiment will be described.

Figure 14:
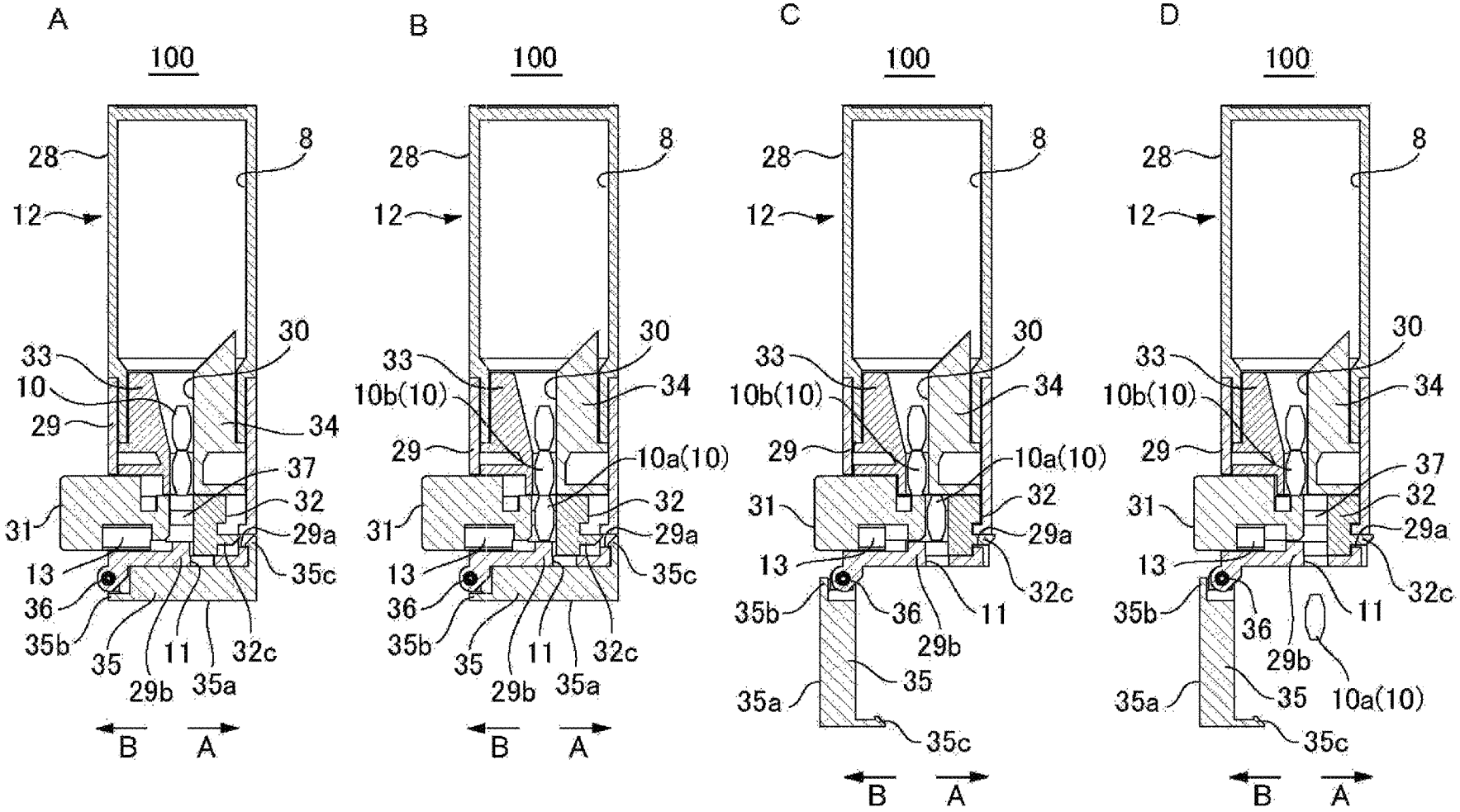
FIG. 14 is a diagram illustrating a flow of an operation of ejecting a pill from the pill case according to the fourth embodiment.

First, the posture of the pill case 100 is adjusted such that the pocket 9 is positioned on the lower side than the accommodation unit 8 (FIG. 14A). In this manner, as illustrated in FIG. 14B, one pill 10*a* is received into the pocket 9 through the path 30, and the pill 10*a* is held by the pocket 9. In this case, the end of the pocket 9 on a side opposite to the accommodation unit 8 side is blocked by the end surface of the second housing member 29, and the falling of the pill 10 from the pocket 9 is regulated. The operations described so far are the same as the third embodiment.

Next, the pill ejection button 31 is pressed in the arrow A direction (FIGS. 14C and 14D). In this case, since the locking state of the locking portion 35*c* with respect to the to-be-locked portion 29*a* is released by the locking releasing portion 32*c*, the opening and closing lid 35 can be opened.

When the pill ejection button 31 is pressed in the arrow A direction until the pill ejection button 31 and the second portion 32 respectively reach the second position and the fourth position, the pill 10*a* in the pocket 9 faces the extraction port 11. In this case, the movement of the second portion 32 to the fourth position is detected by the detection sensor 16. When the press manipulation to the pill ejection button 31 is released, the pill 10*a* flows down or falls, by its own weight, from the pocket 9 through the extraction port 11, and is ejected to the outside of the pill case 100 (FIG. 14D).

The pill ejection button 31 returns to the first position (refer to FIGS. 14A and 14B) according to the bias of the spring 13. In this case, the second portion 32 returns to the third position (refer to FIGS. 14A and 14B) by being pulled by the pill ejection button 31 through the connection portion 37.

In addition, in a state in which the pill 10 is not accommodated in the pocket 9, even when the pill ejection button 31 is manipulated to be moved to the second position, the connection portion 37 is bent and the opposite interval between the pill ejection button 31 and the second portion 32 is reduced so that the second portion 32 is not moved up to the fourth position. Therefore, the movement of the detection target unit 32*a* in association with the movement of the second portion 32 is not detected by the detection sensor 16. In addition, since the locking portion 35*c* is not batted by the locking releasing portion 32*c*, the locking state of the locking portion 35*c* with respect to the to-be-locked portion 29*a* is maintained, and the opening and closing lid 35 is maintained in the closed state.

According to the fourth embodiment described above, the pill case 100 includes the opening and closing lid 35 which can be converted to the first state in which the extraction port 11 is shielded from the outside, and the second state which causes the extraction port 11 to communicate with the outside, and a locking mechanism (the locking portion 35*c* and the to-be-locked portion 29*a*) which engages with the opening and closing lid 35 to maintain the opening and closing lid 35 in the first state. When the second portion 32 is moved to the fourth position, the locking state of the locking mechanism is released so that the opening and closing lid 35 can be converted to the second state.

Thus, it is possible to protect the extraction port 11 from the outside except a case of extracting the pill 10, and thus it is possible to maintain the extraction port 11 in a clean state. In addition, the opening and closing lid 35 can be converted to the second state in conjunction with the ejection operation of the pill 10.

It is not necessary that the constituent elements in the above-described embodiments are independently present. A plurality of constituent elements may be formed as one member, one constituent element may be formed by a plurality of members, a certain constituent element may be a part of another constituent element, and a part of a certain constituent element and a part of another constituent element may be overlapped.

For example, in the first embodiment, an example in which the moving member 15 separated from the pill tray (the second portion) 5 is the moving unit is described, but a part of the pill tray (the second portion) 5 may be the moving unit.

In addition, in the embodiments described above, an example in which the first portion of the manipulation unit is directly manipulated to be moved by a user is described, but the first portion of the manipulation unit may be indirectly manipulated to be moved by a user. That is, the first portion of the manipulation unit may be moved by being pressed by a member which is directly manipulated by a user.

This application claims priority on the basis of Japanese Patent Application No. 2014-188520, filed on Sep. 17, 2014, and the entire disclosure thereof is incorporated herein.

What is claimed is:

1. A pill case comprising:

a case main body provided with an accommodation unit configured to accommodate a plurality of pills;

a pocket configured to receive a pill, of the plurality of pills, from the accommodation unit;

an extraction port configured to elect the pill in the pocket to the outside;

a manipulation unit configured to convert a first state, in which the pill in the pocket cannot be ejected through the extraction port, to a second state, in which the pill in the pocket can be ejected through the extraction port, by being moved by a manipulation in a first direction relative to the case main body by a user;

a moving unit configured to be moved by receiving a pressure from the pill in the pocket by a manipulation of the manipulation unit;

a detection unit configured to detect that the moving unit is moved into the second state;

a tray comprising a projection projected from the pocket and onto an interior wall of the manipulation unit; and a biasing unit configured to bias the manipulation unit in a second direction away from the pocket and opposite the first direction;

wherein the manipulation unit includes:

a first portion having a first surface configured to be manipulated to be moved relative to the case main body by the user; and a second portion having a second surface facing the first surface of the first portion, wherein the pocket is defined between the first surface of the first portion and the second surface of the second portion, wherein the first portion of the manipulation unit comprises a slit, extended in at least one of the first direction and the second direction and having a first end facing the second surface of the second portion, and a first locking portion blocking the first end of the slit, wherein the second portion of the manipulation unit includes a second locking portion, of the projection, inserted into the slit of the first portion and offset from the first locking portion of the first portion in the second direction, wherein, in a case in which the pill is in the pocket, the first portion of the manipulation unit is movable in the first direction such that the first surface of the first portion presses through the pill and to the second surface of the second portion, wherein, in a case in which the pill is not in the pocket, the first portion of the manipulation unit is moveable in the first direction such that the first locking portion of the first portion goes away from the second locking portion in the first direction, and wherein, in the case in which the pill is in the pocket, the biasing unit is further configured to bias the first portion in the second direction such that the pocket is moved in the second direction while the first locking portion of the first portion and the second locking portion of the second portion are locked with each other, and wherein the inner surface of the manipulation unit comprises the first locking portion.

2. The pill case according to claim 1, wherein the manipulation unit is configured to press the pill in the pocket so as to move the pill up to a position at which the pill can be ejected through the extraction port, wherein the moving unit is configured to be moved by being pressed by the manipulation unit through at least the pill, and wherein the first direction in which the manipulation unit presses the pill and a direction in which the moving unit is pressed are the same direction.

3. The pill case according to claim 1, wherein the manipulation unit is configured to press the pill in the pocket so as to move the pill up to a position at which the pill can be ejected through the extraction port, wherein the manipulation unit includes a flat surface which presses the pill in the pocket, and wherein the first direction is orthogonal to the flat surface.

4. The pill case according to claim 1, further comprising:

a returning regulation unit configured to hold the second portion, in the case in which the pill is not in the pocket, and to regulate a returning of the second portion and a returning of the first portion according to a bias of the biasing unit; and a release manipulation unit which performs release manipulation of releasing a holding state of the second portion by the returning regulation unit, wherein when a holding state of the second portion by the returning regulation unit is released by a release manipulation, according to the bias of the biasing unit, the first portion is moved in the second direction, and the second portion is moved in the second direction.

5. The pill case according to claim 4, wherein the returning regulation unit is further configured to hold the second portion by engaging with the second portion.

6. The pill case according to claim 1, further comprising:

a shielding unit configured to shield the pocket and the accommodation unit from the outside of the pill case in the second state before the manipulation unit is manipulated to be moved.

7. A pill case comprising:

a case main body provided with an accommodation unit configured to accommodate a plurality of pills;

a pocket configured to receive a pill, of the plurality of pills, from the accommodation unit;

an extraction port configured to elect the pill in the pocket to the outside;

a manipulation unit configured to convert a first state, in which the pill in the pocket cannot be ejected through the extraction port, to a second state, in which the pill in the pocket can be ejected through the extraction port, by being moved by a manipulation in a first direction relative to the case main body by a user;

a moving unit configured to be moved by receiving a pressure from the pill in the pocket by a manipulation of the manipulation unit;

a detection unit configured to detect that the moving unit is moved into the second state;

a tray comprising a projection projected from the pocket and onto an interior wall of the manipulation unit; and a biasing unit configured to bias the manipulation unit in a second direction away from the pocket and opposite the first direction;

wherein the manipulation unit and the tray are configured such that, in a case that the pill is not in the pocket, the manipulation moves the projection away from the interior wall of manipulation unit and also moves the manipulation unit into the pocket, and wherein the manipulation unit and the tray are further configured such that, in a case that the pill is in the pocket, the manipulation presses the manipulation unit and the pill in the first direction such that a force of the manipulation is applied through the pill and into the tray which moves the tray in the first direction thereby engaging a lock between the projection and the interior wall of the manipulation unit such that the manipulating the manipulation unit moves the manipulation unit, the pill and the tray in the first direction without moving the manipulation unit into the pocket.

* * * * *